US009279265B1

(12) United States Patent
Nead

(10) Patent No.: US 9,279,265 B1
(45) Date of Patent: Mar. 8, 2016

(54) TEMPORARY SHELTER SYSTEM

(71) Applicant: Daniel Morrell Nead, Johnson City, NY (US)

(72) Inventor: Daniel Morrell Nead, Johnson City, NY (US)

( * ) Notice: Subject to any disclaimer, the term of this patent is extended or adjusted under 35 U.S.C. 154(b) by 0 days.

(21) Appl. No.: 14/090,187

(22) Filed: Nov. 26, 2013

Related U.S. Application Data

(60) Provisional application No. 61/729,670, filed on Nov. 26, 2012.

(51) Int. Cl.
*E04H 9/10* (2006.01)
*E04H 9/04* (2006.01)

(52) U.S. Cl.
CPC .. *E04H 9/10* (2013.01); *E04H 9/04* (2013.01); *Y10S 52/12* (2013.01); *Y10S 52/14* (2013.01)

(58) Field of Classification Search
CPC ..... E04H 9/04; E04H 9/06; E04H 9/10; Y10S 52/12; Y10S 52/14
See application file for complete search history.

(56) References Cited

U.S. PATENT DOCUMENTS

| | | | | | |
|---|---|---|---|---|---|
| 592,190 | A * | 10/1897 | Bond | 52/125.2 |
| 1,540,988 | A * | 6/1925 | Hensel | 109/49.5 |
| 2,327,869 | A * | 8/1943 | Carlson | 52/122.1 |
| 2,792,794 | A * | 5/1957 | Miller | 52/66 |
| 2,846,962 | A * | 8/1958 | Morgan | 52/65 |
| 3,008,435 | A * | 11/1961 | Dupuy | 109/1 S |
| 4,489,810 | A * | 12/1984 | Curtis | 312/272.5 |
| 5,671,568 | A * | 9/1997 | Armanno, Sr. | 52/66 |
| 6,732,479 | B2 * | 5/2004 | Nomura et al. | 52/64 |
| 2002/0083651 | A1 * | 7/2002 | Nomura et al. | 52/1 |

FOREIGN PATENT DOCUMENTS

| | | | |
|---|---|---|---|
| DE | 615724 | C * | 1/1936 |
| DE | 954995 | C * | 12/1956 |
| DE | 19700912 | A1 * | 8/1997 |
| DE | 102011106573 | A1 * | 9/2012 |
| GB | 471630 | A * | 9/1937 |
| GB | 507415 | A * | 6/1939 |
| GB | 525119 | A * | 8/1940 |
| GB | 536540 | A * | 5/1941 |

* cited by examiner

*Primary Examiner* — Rodney Mintz
(74) *Attorney, Agent, or Firm* — Mark Levy; Hinman, Howard & Kattell, LLP

(57) ABSTRACT

A shelter system is disclosed which comprises three central elements. A rotatable barrier element provides protection from incoming ballistic threats. The barrier functions on the principle of detonating, absorbing, and deflecting incoming threats away from a designated area of the shelter. A protective envelope element utilizes a compartmentalized vessel, two containment components, and a strata of alternating compacted fill and interstitial plate layers; the strata is enclosed within the vessel and two containment components. The interstitial plates serve a dual role in providing a compaction surface in the fill method and layering for the mitigation of ballistic threats. The design of the vessel permits each vessel to be filled while positioned flat on the ground surface; once filled and sealed, multiple vessels may be re-positioned in vertical, horizontal, sloped, or spanning arrangements. An A-frame based structural element functions as the fulcrum for the rotatable barrier and as the mount for the envelope trays. The structural system has an option of fastening to the framing system of the standard conex container.

12 Claims, 31 Drawing Sheets

I
284
278
280
282

II
284
278
282
280

III
282
284
278
286
288

VS

+ section q-q (detailed)

TEMPORARY SHELTER SYSTEM

RELATED PATENT APPLICATIONS

This application is based upon and claims the priority of provisional patent application No. 61/729,670, filed on Nov. 26, 2012, incorporated herein by reference in its entirety.

FIELD OF THE INVENTION

This invention is directed to temporary shelter systems including a rotatable barrier system, an envelope system with material-fill apparatus, and an associated A-frame based structural system for both the rotatable barrier and the envelope.

BACKGROUND OF INVENTION

In combat, civil defense, civil unrest, border security and disaster related situations, there is often a need for a temporary shelter that can be rapidly deployed, assembled, and extracted. In these situations, the shelter must provide protection from enemy and/or environmental threats. In some instances it is advantageous that the shelter be delivered and extracted via helicopter. Contemporary military shelter practices are varied. Common shelter types include tent structures, plywood huts, purpose designed conex units and improvised shipping conex reuse. These shelter types do not typically provide protection from direct and indirect fire. In cases where protection is provided, conventional armored shelter types are comparatively heavy and expensive structures. These characteristics are not ideal for widespread use or for operations requiring rapid deployment and mobility; such operations have become the norm. Additionally, non-armored shelters are often reinforced with earth-fill protection. Gabions and/or sandbags are applied to the envelope of the shelter or they form offset barriers to prevent collateral damage between shelter units. High trajectory indirect fire is one of the more common threats faced by military bases during stability operations. Current earth-fill protection systems afford little to no protection against direct hits as these systems lack the internal structure to effectively span horizontal distances. Furthermore, the fill techniques are either machine reliant or are tedious when performed manually. A shelter system that reduces machine reliance and fill time, mitigates relevant threats, increases both the standardization of components and performance, improves livability, is modular, reusable, upgradeable, and heli-deployable and does so at a comparatively minimal cost would be well suited for a variety of roles in combat, civil defense, civil unrest, border security and disaster related scenarios.

SUMMARY OF INVENTION

Accordingly, this invention provides a temporary shelter system that requires minimal setup and extraction time and provides improved protection options from common ballistic and explosive threats. The shelter makes use of a rotatable barrier system that operates on the principle of a lever. A planar contact surface absorbs the energy of a ballistic threat and the threat's associated blast and deflects the threat and its associated blast path away from a protected area behind, below, or above the rotatable barrier. In the favored embodiment, the rotatable barrier forms a roof element offset and above the shelter's envelope. The contact surface is fixed to an axle that facilitates its rotation. The contact surface comprises a mount for an offset detonation element and an absorption component. The axle doubles as a liquid storage tank. The axle and its housing are supported by an A-frame based structural system; these elements serve as the fulcrum during the rotation of the contact surface.

The protected area is further enclosed in a modular envelope system. A plurality of compartmentalized vessels, of finite dimension, align to form roof and wall surfaces to fully enclose the protected area. Each vessel comprises four sidewalls that together give the vessel an autonomous structural capacity; the vessels also have mirrored top and bottom cover components that fully enclose a compacted fill and interstitial plate strata. The structural capacity of the vessel and the provision of covers facilitate the repositioning, rotation, and spanning capabilities of each vessel following its fill process. Prior to placement, the fill process occurs with the vessel flat on the ground, thereby reducing the range of motion required to fill the vessel. The fill process establishes the strata within the vessel. The interstitial plates are of the general length and width of each vessel compartment and serve as a press plate to actively compact the material fill layers as each subsequent layer is added. In one embodiment, the compaction process is accomplished by an individual jumping on the inserted plate with the fill material below; a desirable number of layers are added and the vessel is sealed with mirrored containment cover components. The strata mitigates the penetration of a projectile as the projectile passes through alternating layers of compacted fill material and the ballistic plates. A compressible gasket rings the skirting on each cover component to provide a seal when at least two vessels are positioned adjacent to one another to form a wall, roof, or floor surface; the seal is maintained through the compression of, and line of contact between the gaskets. The vessels are organized and supported by the same framing system that supports the rotatable barrier.

Multiple options exist for the arrangement of the envelope, framing, and rotatable barrier systems in relation to each other component(s). The employment of the rotatable barrier as an offset roof element from the vessel envelope is the focus of three embodiments, as it presents a possible means to defeat common high trajectory ballistic threats. The roof barrier condition also presents secondary applications for improved tactical and habitability performance.

In all illustrated embodiments, at least two A-frames are parallel and offset from one another to form the longitudinal axis of the shelter. The cylindrical axle component is aligned with the longitudinal axis and is received by and supported by circular openings, that compose the housing system, at the apex of each A-frame. The rotatable barrier serves as an offset roof structure. Various forms of end bracing provide support to each of the outermost A-frames by running orthogonally from the legs of the main A-frame to the ground surface. Secondary lateral bracing is provided by members running laterally along the legs of the main offset and parallel A-frames. The end bracing may also have secondary lateral bracing; the secondary lateral bracing also serves as the rests and/or attachment points for the specified vessel arrangements. One embodiment of the shelter incorporates the structural capacity and enclosure characteristics of the conex container into the framing system. The two other embodiments, which are illustrated, operate independent of a conex container. Of the two non-conex based embodiments, one embodiment utilizes smaller A-frames for end-bracing and incorporates horizontal vessel placement in the provision of an observation deck and envelope roof element. The second of the non-conex based embodiments has a simpler framing system, but uses a port and shutter system in place of the horizontal vessel element. The conex based embodiment, which is illustrated, is similar in form and function to the first conex independent embodiment in all features other than an alternative provision for end framing and a distinct provision for intermediary framing members that link the A-frame based framing system to that of the conex container. Various supporting elements and details such as, screen systems, seal systems, an optional envelope pre-detonation layer and associated mounting devices, interior axially aligned flange elements of the axle tank component and illustrated applications of delivery and employment assist in understanding and performance of the shelter in its intended forms.

In this effort, the design of the shelter is governed by the following parameters. 1) The shelter provides high trajectory threat mitigation through a unique protection system that detonates, absorbs, and deflects blast energy away from the shelter. 2) The shelter envelope makes use of a novel fill technique and associated apparatus in order to provide customizable protection. This technique uses manpower-based fill and compaction methods in order to maximize efficiency of delivery, assembly and extraction during deployment. 3) The partially assembled structure may be delivered and extracted via helicopter or ground transport. 4) The design enhances and protects the conex container for use as a shelter or in a variety of support roles. 5) The shelter addresses livability standards by providing a pressurized water supply, a thermal barrier, and active solar-energy harvesting capabilities. 6) The design is modular in nature. Multiple shelters, each with a specific tactical and/or support role, may be linked together to form integrated and fully protected installations. 7) The design suits a variety of tactical roles aside from its core role as a shelter. 8) The design emphasizes a minimal number of interchangeable parts as well as a provision for damage to be addressed with localized repairs.

BRIEF DESCRIPTION OF THE DRAWINGS

A complete understanding of the present invention may be obtained by reference to the accompanying drawings, when considered in conjunction with the subsequent detailed description, in which:

FIG. 15 demonstrates the prior state. For clarity, the diagram shares reference numbers with other figures on the same sheet.

DETAILED DESCRIPTION OF THE PREFERRED EMBODIMENT

Figure 1:
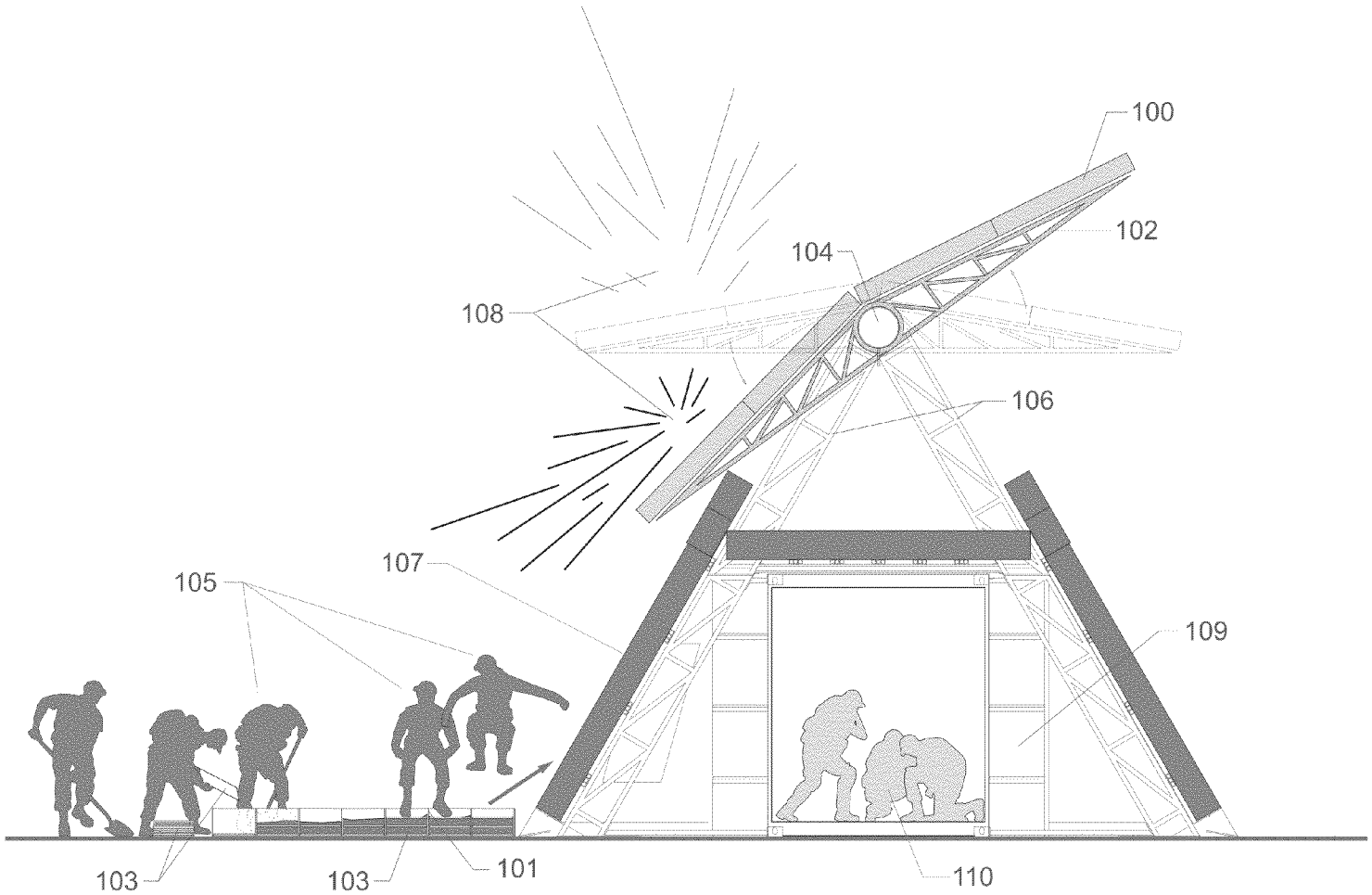
FIG. 1 is a diagrammatic section of the shelter taken generally at section a-a according to one embodiment of the invention, showing the rotatable barrier component in a lighter shade of gray and a portion the envelope component and process in a darker shade of gray.
Figure 3:
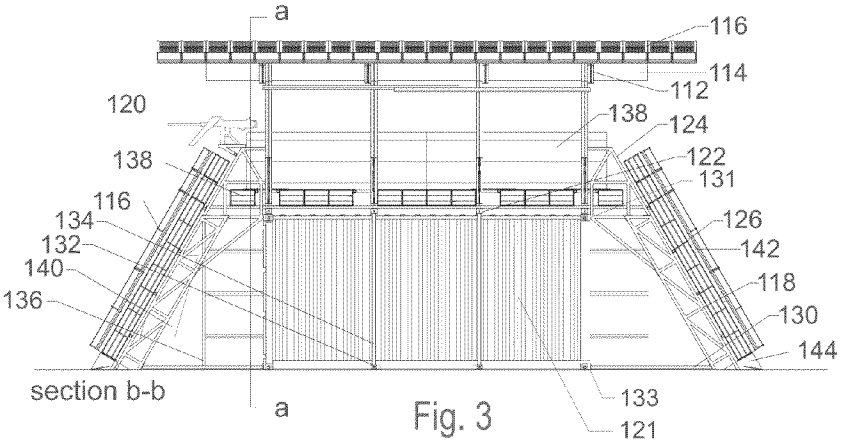
FIG. 3 is a reference view of longitudinal section b-b of the shelter according to one embodiment of the invention. For clarity, the diagram shares reference numbers with other figures on the same sheet.
Figure 2:
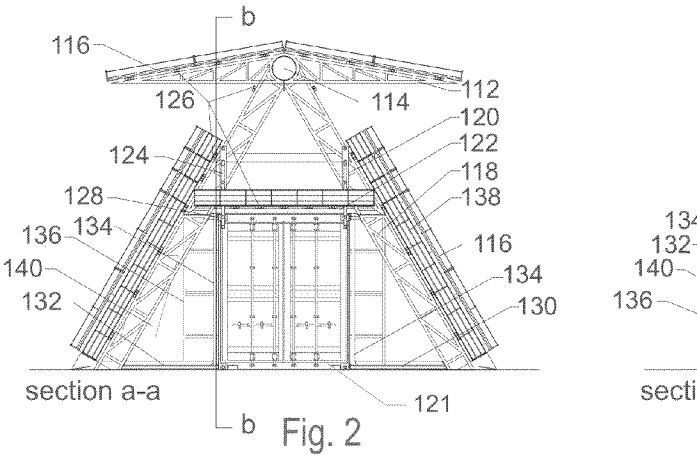
FIG. 2 is a reference view of lateral section a-a according to one embodiment of the invention. For clarity, the diagram shares reference numbers with other figures on the same sheet.
Figure 4:
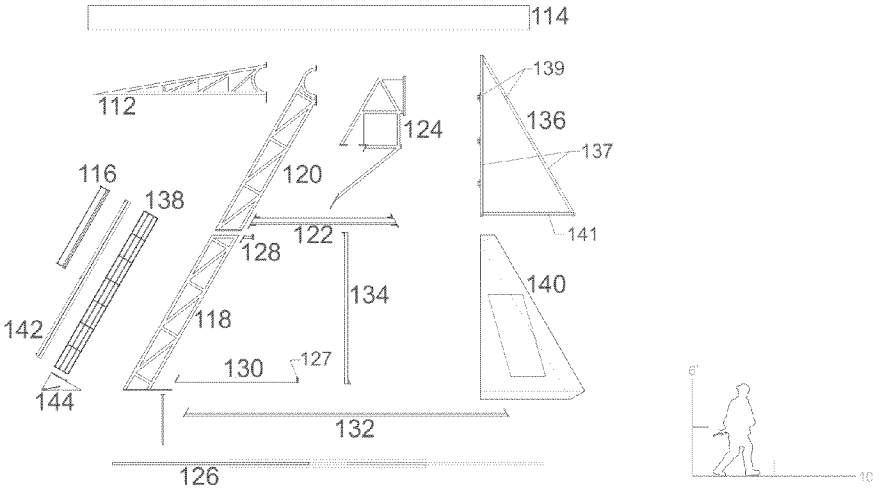
FIG. 4 is a diagrammatical view of the unassembled primary components of the shelter according to one embodiment of the invention. For clarity, the diagram shares reference numbers with other figures on the same sheet.
Figure 5:
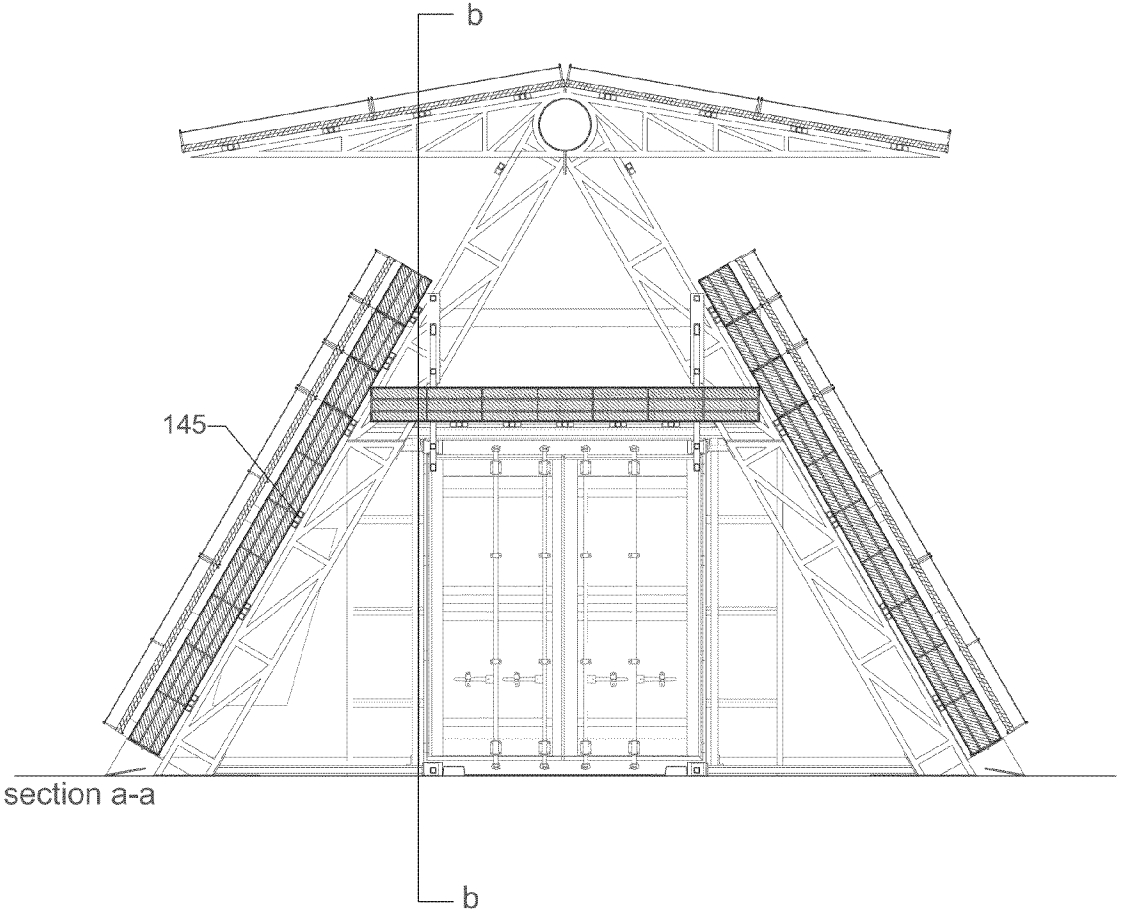
FIG. 5 is a view of lateral section a-a according to one embodiment of the invention, on larger scale than FIG. 2
Figure 6:
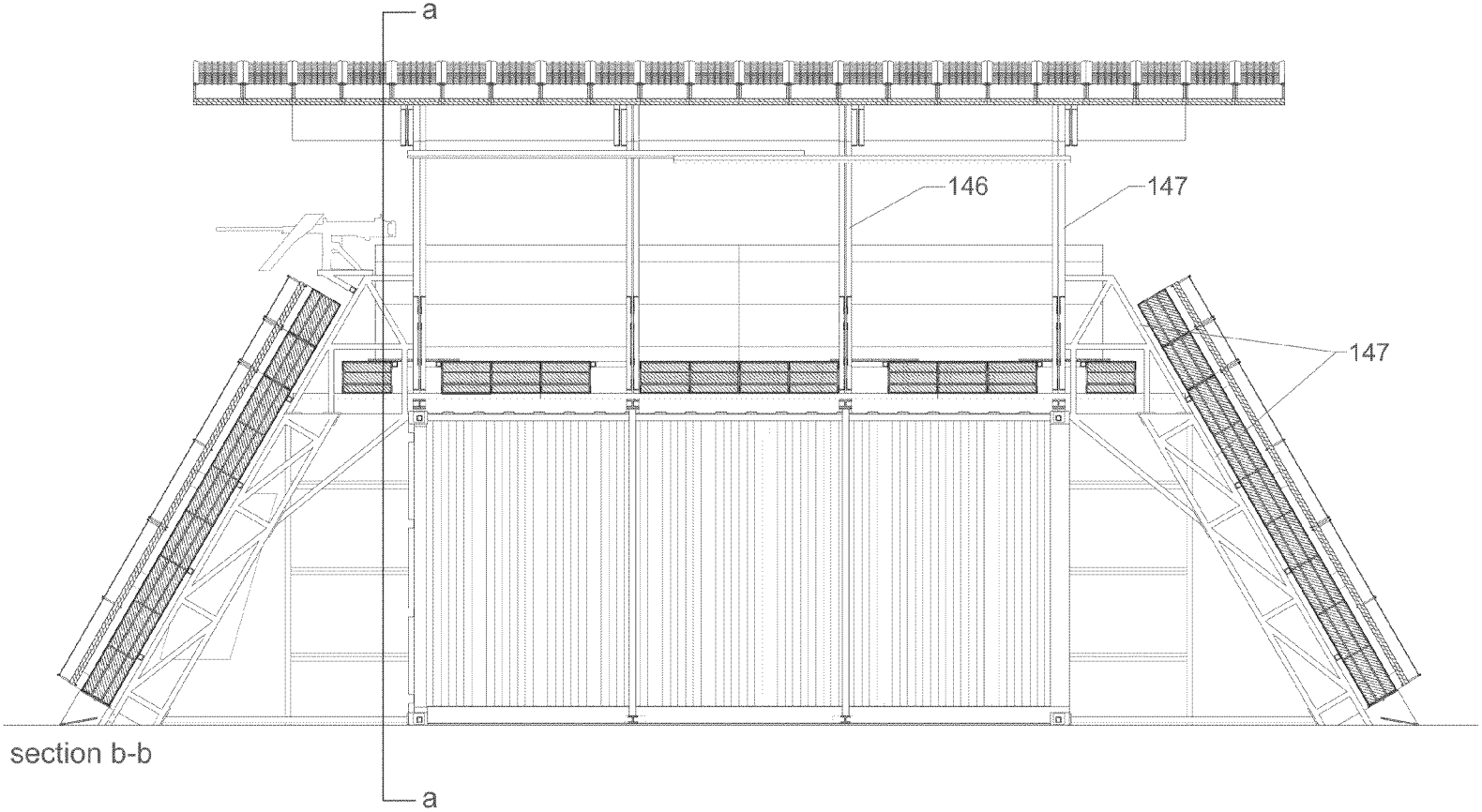
FIG. 6 is a view of longitudinal section b-b according to one embodiment of the invention, on larger scale than FIG. 3

The design of the shelter is divided into two concept areas. The shelter makes use of a rotatable barrier 100 to protect against ballistic and explosive threats 108 and the shelter utilizes a material fill apparatus 101, 103 and technique 105 to establish a protective envelope 107. Both concept components are tied to an A-frame based structural system 106.

The Rotatable Barrier:

A rotatable barrier system comprises a contact surface and an axle component. The axle component comprises a cylindrical shaft 114 and housing 120. The axle housing has a circular opening to receive a portion of the axle shaft in a pin-type connection. The contact surface comprises at least one structural, armored planar surface 100, 149 that is rectangular in form and at least one housing 102, 112 with a circular opening. The circular opening of the contact surface housing receives a portion of the axle shaft in a moment resistant connection and aligns two edges of the rectangular planar surface in a manner parallel to the axle shaft. The axle housing operates as a pin support and is of a form to permit the rotation of the axle and contact surface when acted upon by a ballistic element 108. Upon contact with the contact surface, the path of the ballistic element is redirected from its original course, away from the protected area of the shelter 110. In the process, a portion of the kinetic energy of the ballistic element is transferred into the axle shaft's and attached contact surface's resistance to rotation.

Figure 9:
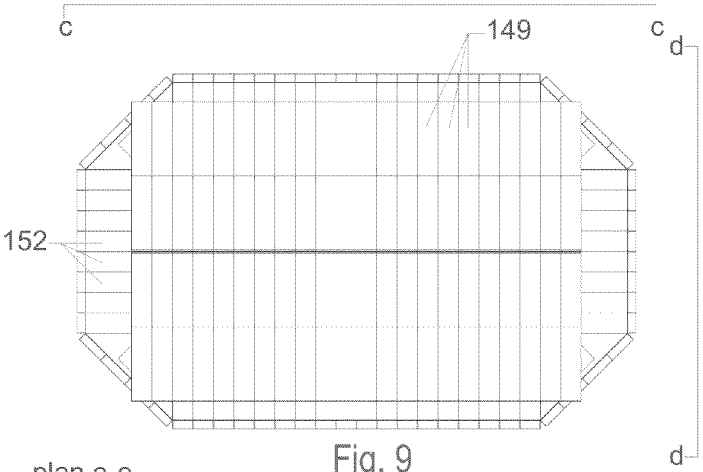
FIG. 9 is a diagrammatical view of plan e-e illustrating the arrangement of vessels on the envelope and pre-detonation screens on the rotatable roof barrier according to one embodiment of the invention. For clarity, the diagram shares reference numbers with other figures on the same sheet.

The rotatable barrier operates on the principle of a lever. The contact surface 278 functions as a lever arm, the axle component 284 and its supporting framing 282 operate as the fulcrum, and the blast from an incoming ballistic threat 280 and the barrier element's resistance to rotation serve as the loads. In a preferred embodiment, the contact surface is in a roof arrangement and comprises an armored but non-structural detonation skin 116, 149 and supporting structural rafter framing 112. The skin is arrayed so as to form the rectangular planar surface of the contact surface, as shown in FIG. 9. The structural rafter framing performs the role of the contact surface housing. The axle housing is contained within and supported by an associated A-frame based structural system 120, 118. The contact surface detonates and/or intercepts a ballistic threat in a position offset from the shelter envelope. Upon contact, the rotatable barrier both absorbs and deflects the threat and blast energy away from the central habitable area 110 of the shelter.

Figure 23:
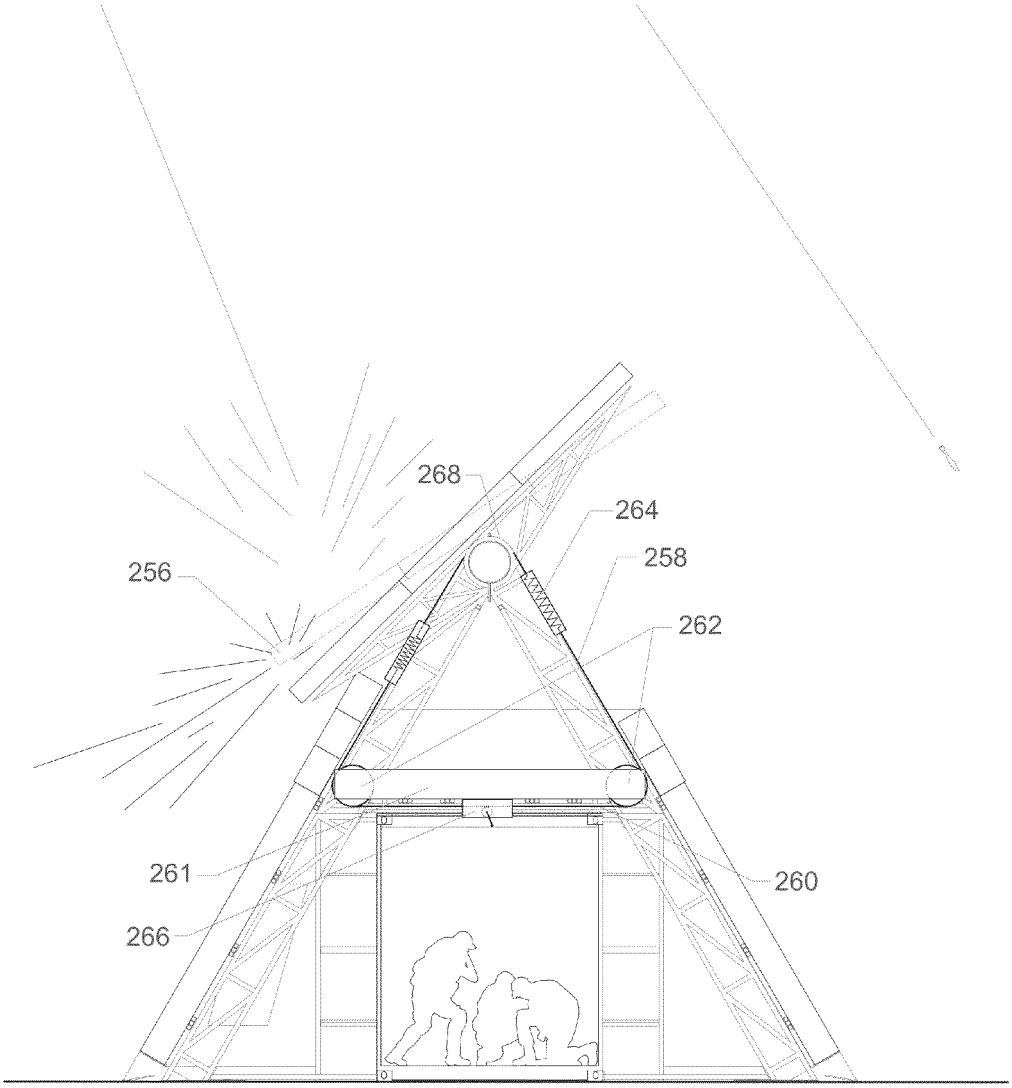
FIG. 23 is a diagrammatical section of the shelter taken generally at section a-a illustrating the spring, pulley, and belt damping system according to one embodiment of the invention.

In the roof barrier embodiment, the contact surface housing comprises a series of rafter members 102, 112; at least two rafter members are each parallel and offset to one another. The rafters are in the form of rafter trusses. A cylindrical axle 104, 114 runs perpendicular and through the center of the rafter trusses along the longitudinal axis of the shelter. In one embodiment, each rafter truss is formed by two mirrored half trusses 112 fastened together at the top and bottom chord members of the respective half trusses. A circular opening is formed at the connection point between the mirrored half trusses. The circular void space allows the rafter trusses to ring and fasten to the cylindrical axle in a moment resistant connection type. A plurality of offset and parallel secondary members 197, 126 run laterally across the rafter trusses in order to link the rafter trusses into a unified structure and to provide attachment points for the detonation skin 116, 149; the detonation skin is the planar element, that with the rafter trusses and associated secondary lateral members, compose the contact surface. The detonation skin is a surface capable of detonating and absorbing at least a portion of the blast load and in so transfer the kinetic energy of the ballistic threat into the kinetic energy of the barrier's movement. In one embodiment, the kinetic energy is also transferred into the potential energy of a spring and belt system, as illustrated in FIG. 23. In one embodiment the roof barrier's function is not to provide protection to personnel on the observation deck 246, rather its function is to reduce the devastating effect of a direct hit and thereby facilitate the envelope system's ability to mitigate the penetration of the ballistic element, its residuals and/or shrapnel. The protected area 110, 109 is the volume within the envelope system 107. Depending on threat type, the rotating barrier may also provide adequate protection for personnel on the observation deck.

Figure 15:
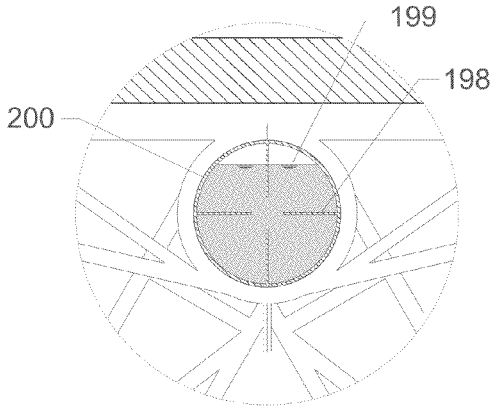
FIG. 15 is a diagrammatical detail of Reference No. 186 in FIG. 12 illustrating the settled state of the axle-tank prior to rotation according to one embodiment of the invention. For clarity, the diagram shares reference numbers with other figures on the same sheet.
Figure 16:
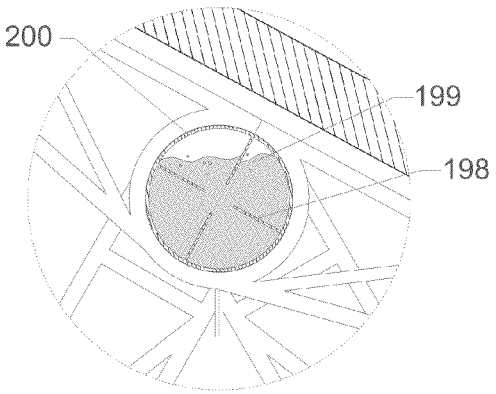
FIG. 16 is a diagrammatical detail of Reference No. 186 in FIG. 12 illustrating the hydraulic resistance provided by the radially aligned flanges within the axle-tank during rotation according to one embodiment of the invention.
Figure 17:
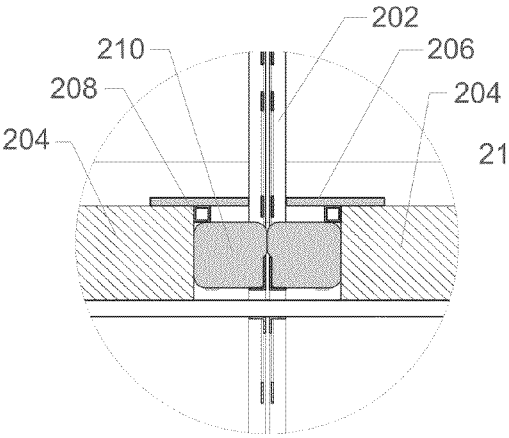
FIG. 17 is a diagrammatical detail of Reference No. 174 in FIG. 11 illustrating the ceiling vent and associated components according to one embodiment of the invention.
Figure 18:
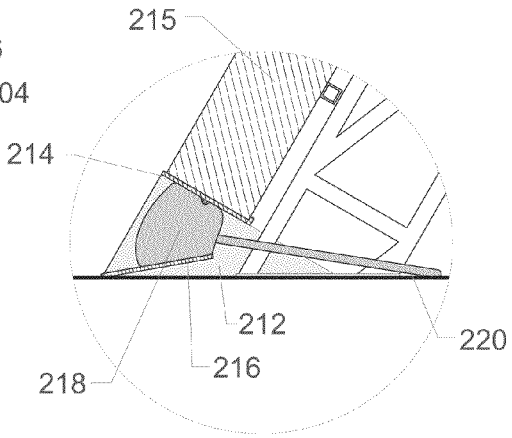
FIG. 18 is a diagrammatical detail of Reference No. 176 in FIG. 11 illustrating the pedestal vent and its associated components according to one embodiment of the invention.
Figure 19:
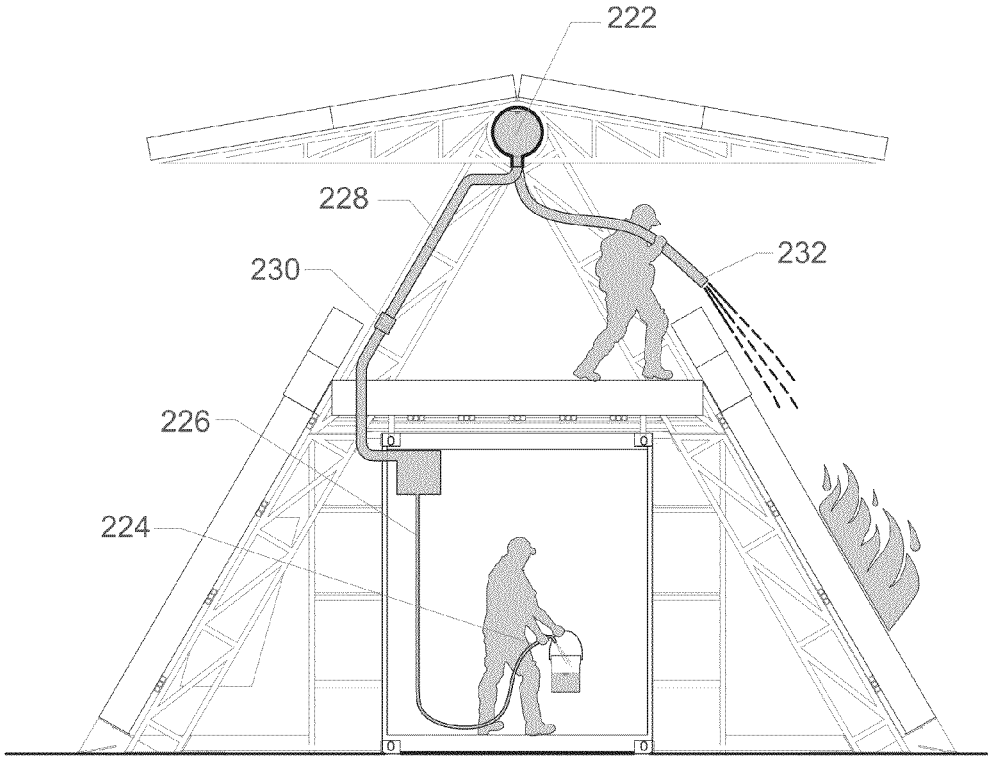
FIG. 19 is a diagrammatical section of the shelter taken generally at section a-a illustrating the axle tank component and use thereof according to one embodiment of the invention.

As illustrated in FIG. 19, in a preferred embodiment, the cylindrical axle doubles as a liquid storage tank 222 with the purpose(s) of: providing a pressurized supply of potable water 224 or other liquid 478 to the shelter's personnel, providing a source for additive moisture control during the compaction phase of the envelope fill process, increasing the moment of inertia for the rotation of the roof element, providing a significant barrier in the case of a direct hit on the cylindrical axle that does not induce rotation and deflection, and providing an immediate source 232 for fire (flame) response. At least one hose attachment 228, 226 is used to deliver the liquid within the tank to the habitable space within the envelope or an area adjacent to the shelter. In a preferred embodiment, a hose coupling 230 is positioned at the level of the observation deck; the hose is pulled from the coupling to provide an immediate high volume flow of water. In a preferred embodiment, the axle-tank has interior flanges 186, 198 radially aligned so as to provide more effective hydraulic resistance of the liquid 199 within the axle-tank during the rotation of the axle-tank, thereby increasing the effective moment of inertia for the rotation of the barrier, as shown in FIGS. 15 and 16. In one embodiment, the flanges 198 do not form compartments within the axle tank. In one embodiment the flanges 192 form compartments within the axle tank by extending across the full diameter of the cylinder.

In various embodiments, the rotation and the resting position of the rotatable barrier is controlled to actively respond to identified threats as well as to serve the secondary roles related to habitability and tactical potential. In one these embodiments of the rotatable barrier system, damping and control of the roof rotation is provided by at least one spring connector component, at least one belt component, at least one pulley wheel and an aligned and recessed track on the axle; together these components compose a damping system, as shown in FIG. 23. A preferred embodiment of the damping system comprises two pulley wheels 262 or pinions that are fastened to the mirrored legs 106 of the main A-frame, a vertically aligned recess 268 on the cylindrical axle, the belt 258, a device to drive the belt 266, and at least one damping connector 264 or equivalent absorption device. The belt path follows the line and angle of the A-frame legs and runs along a triangular path between the recessed track on the cylindrical axle and the two pulley wheels anchored near the midpoints of the mirrored A-frame legs, as shown in FIG. 23. A damping connector splits at least one belt span. The lower belt segment 260 runs below the horizontal envelope 261 of a preferred envelope embodiment. The damping device dissipates the energy transferred to the barrier during an induced rotation of the barrier.

Figure 43:
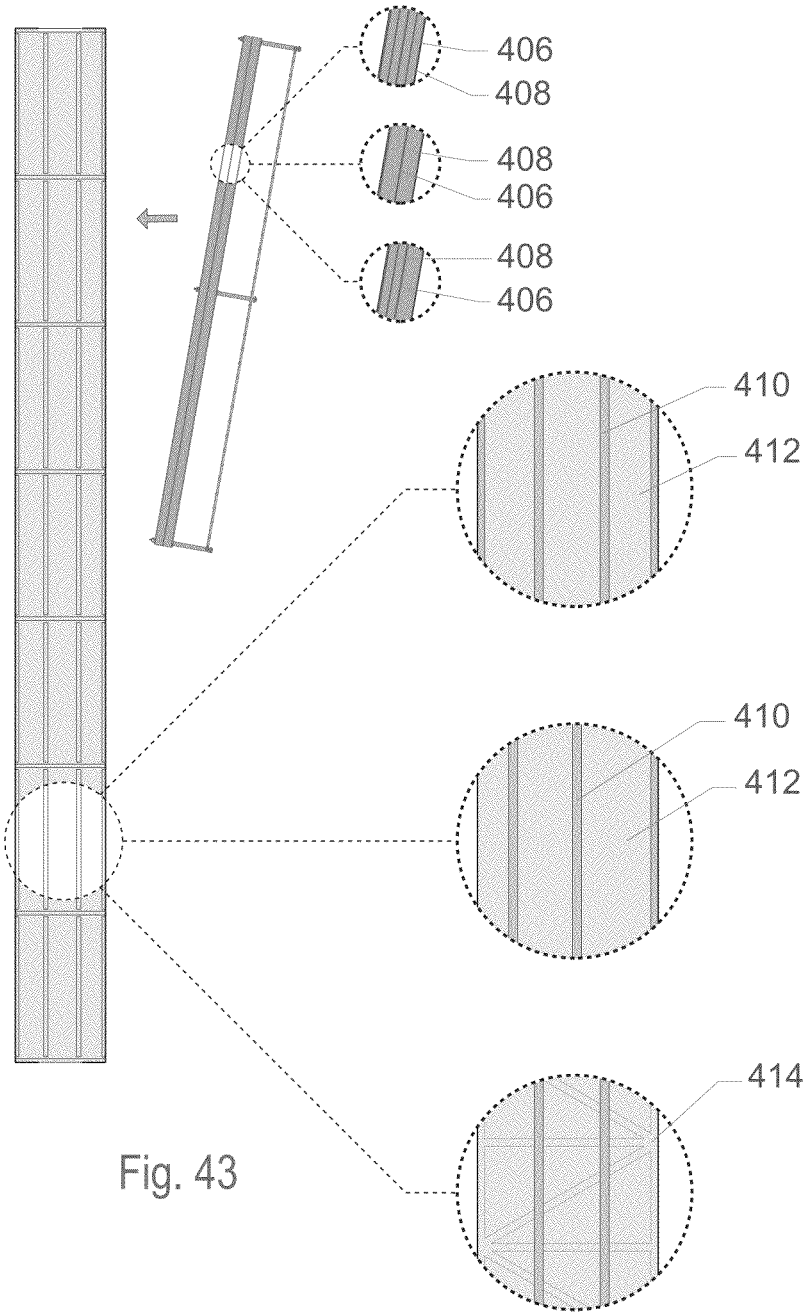
FIG. 43 is a diagrammatical section of a filled vessel and detached pre-detonation screen according to one embodiment. The diagram illustrates options for gradation and number of layers for both the vessel's strata and the absorption component of the pre-detonation screen. The diagram also illustrates one embodiment of the vessel wherein the structural sidewall is formed of a designated structural piece (dashed lines) and designated skin piece.
Figure 44:
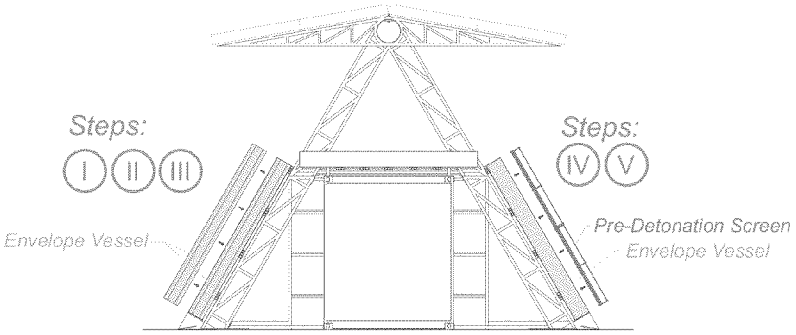
FIG. 44 is a sectional reference diagram illustrating the steps in FIG. 45. The roman numerals correspond to a series of steps within FIGS. 44 and 45.

In a preferred embodiment of the rotatable barrier system, pre-detonation screens 116, 344 align to form a rectangular planar surface and in so compose the detonation skin of the contact surface 149. Each pre-detonation screen comprises an absorption component 349 and a mount component 388 for an existing detonation element 390. The detonation element is offset from the absorption component by the mount and therefore initiates the detonation of a threat before it reaches the absorption component of the screen. In one embodiment, the absorption component of the screen comprises at least one frame 380, 408 in-between sheets of paneling 370, 406. The frame comprises two parallel side members 376 with at least two linking members 374 running perpendicular to the side members to form a rectangular perimeter. At least one frame is sandwiched in-between the sheets of paneling; the frames and sheeting alternate layers when more than one frame component present. In one embodiment, absorptive massing material is packed in the void space 382 formed by the frames and sheeting. In various embodiments, the absorptive material comprises specially manufactured blast-foam, egg-crate material, synthetic ultra-light materials, phase-change materials, flame mitigation substances or other mission relevant material. One embodiment designates leaving the void space empty. The sheeting and frames are fastened together with at least four threaded rods 372 or an equivalent rod member. The threaded rods run through and are received by the aligned holes in both the frames and the paneling. Each threaded rod extends several inches past the outer face of the frame and sheeting. The extra length of threaded rod aligns with and is received by a mounting component for the detonation element of the screen. The mounting component for the detonation element comprises at least four sleeve members 386. Each sleeve member is attached to two adjacent sleeve members by at least one orthogonally aligned mounting rod 388 to form a rectangular shape roughly the same size and rectangular shape as the frame element. The mounting component is fastened by washers and nuts or an equivalent fastening system at the end of the threaded rods. The mounting rods are the attachment point for the existing detonation element, be it a slat armor system, a lighter netting-based product 390, or similar device. The number, type, and arrangement of layers 406, 408 in the screen are customizable for various threat types as shown in FIG. 43. In various embodiments, the pre-detonation screens are constructed of materials, or accept attachments to, reduce thermal loading, manipulate thermal signature, protect against EMP attack, reduce visual profile among other mission relevant functions.

Figure 20:
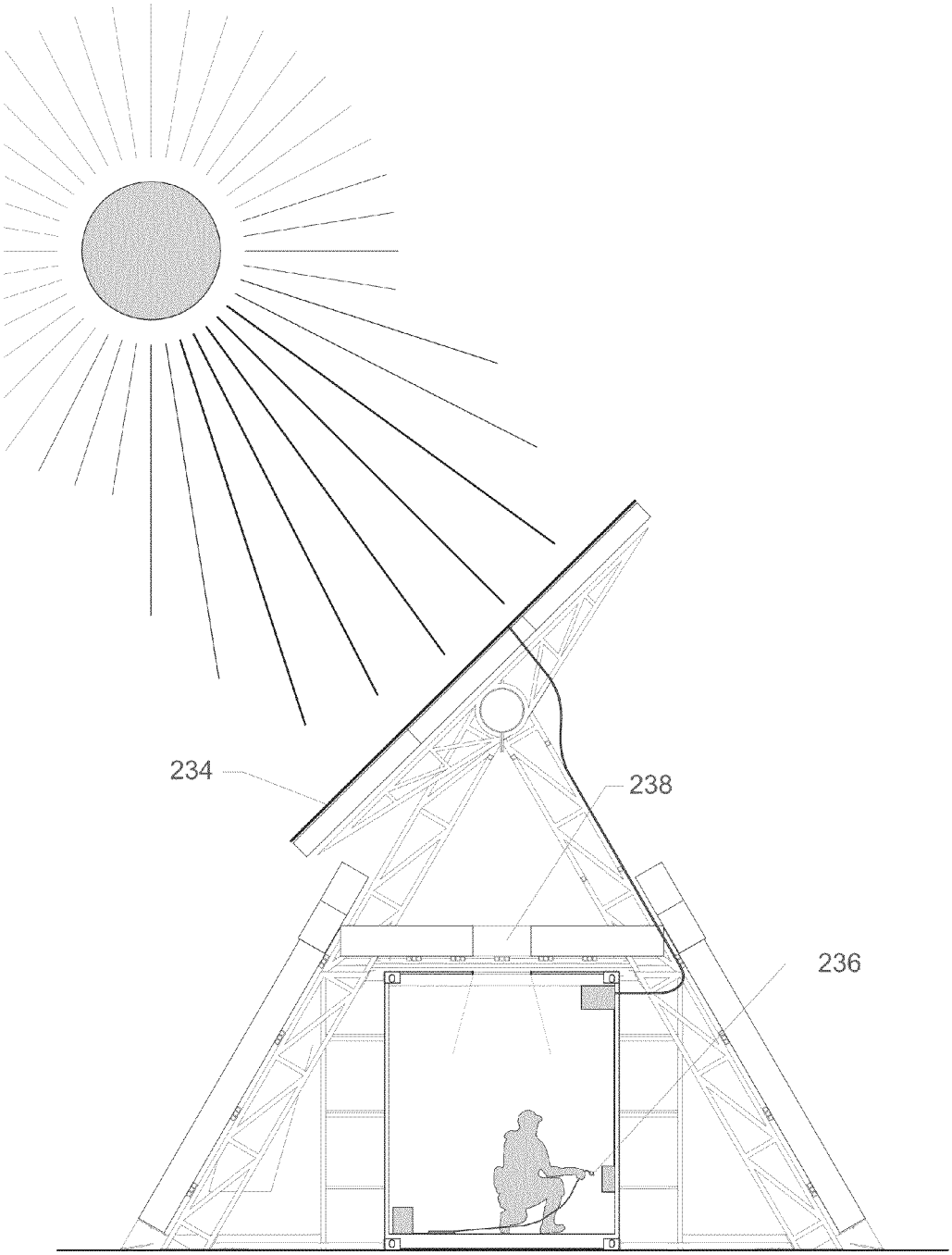
FIG. 20 is a diagrammatical section of the shelter taken generally at section a-a illustrating the application of a solar cell device to harvest solar energy according to one embodiment of the invention.

In a preferred embodiment, the roof is at least temporarily blanketed with a photovoltaic (PV) tarp 234, textile, or other form of solar cell. The PV element fastens to the rotatable roof framing system and/or rests on top of the detonation skin as shown in FIG. 20. The roof is rotated in order to maximize solar gain for the PV element and in the process reduce the thermal load on the habitable portion of the structure. The rotatable roof provides protection from the elements. Consequently, in one embodiment, natural lighting and ventilation openings 238 are incorporated into the horizontal surface of the envelope system while maintaining effective shelter from precipitation and direct solar gain.

Figure 21:
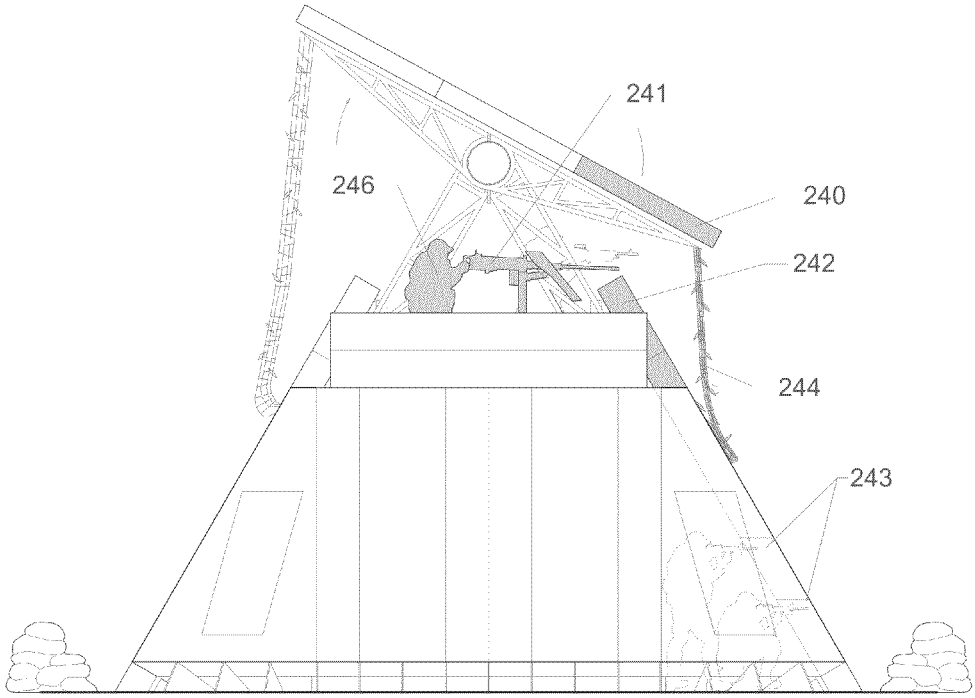
FIG. 21 is a diagrammatical elevation of the shelter taken generally at elevation d-d illustrating the tactical potential of reducing the defender's profile according to one embodiment of the invention.
Figure 22:
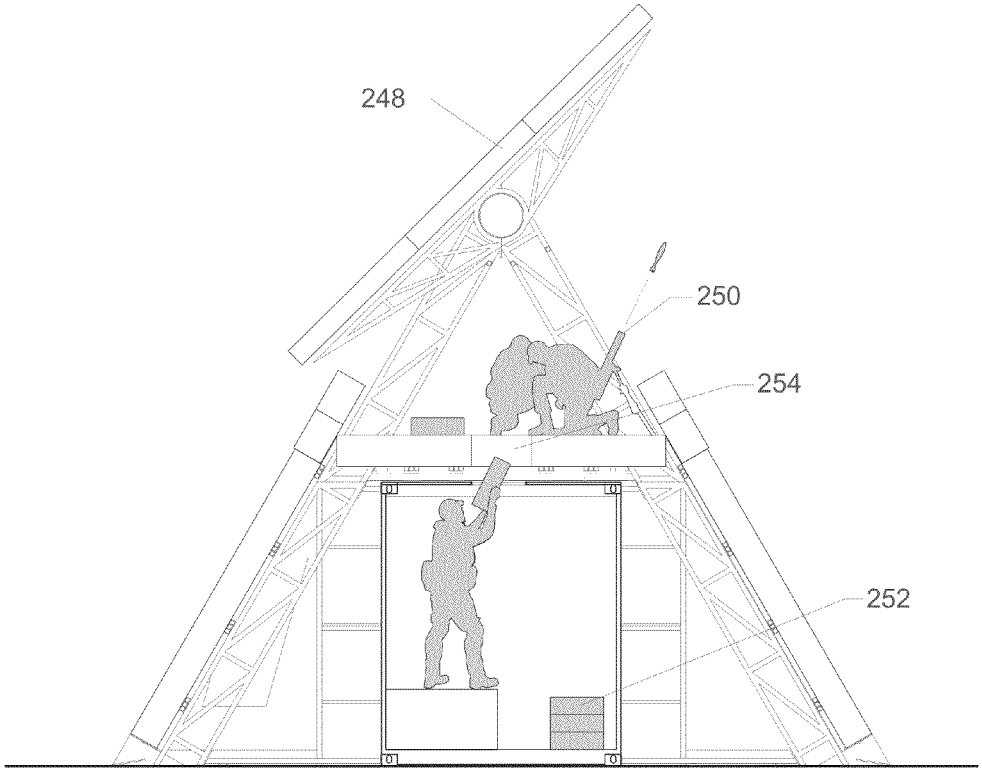
FIG. 22 is a diagrammatical section of the shelter taken generally at section a-a illustrating the tactical potential of the rotatable barrier in providing a clear field of fire for a mortar according to one embodiment of the invention.

In combat scenarios, one embodiment of the shelter facilitates the temporary rotation of the roof 240, thereby providing a more limited target profile of the defenders 246, as shown in FIG. 21. In one embodiment, visual obstruction netting 244 is attached to the edges of the rotatable barrier and hung to further conceal personnel. In one embodiment, the barrier may be temporarily rotated to facilitate a clear field of fire for mortar 250 use on the observation deck as shown in FIG. 22. The shelter envelope serves as a protected magazine 252; non-mortar systems of fire support 241 are also employed by the shelter via a mounting system attached to the framing system. In the one embodiment, an existing mount type 167 is fastened to a secondary lateral member 145, 126 positioned near the top of the end framing components 148.

The Envelope System:

The fill apparatus 101, 103, 346 and its associated fill technique 105, provide a modular unit for the establishment of a shelter envelope. The fill apparatus of the envelope system provides improved ballistic protection, greatly expanded positioning capabilities, and significantly reduces the manual fill time and range of motion requirements compared to common earth-fill practices.

The basis of the fill apparatus is a rigid, structural, enclosed vessel 346. A vessel comprises at least four attached sidewalls 351, 353, 356, 360 with a void space 358 therewithin, a bottom containment component 352 for the vessel, a cover component 368 for the vessel, and a strata comprising at least one compacted fill material layer 314, 412 and at least one interstitial plate 310, 410; the vessel, its bottom component and its cover component fully envelop the strata 318 that fills the void space 307, 364. In one embodiment, a plurality of vessels 151, 152, 156, 158, 160 align to compose the protective envelope of the shelter.

Figure 32:
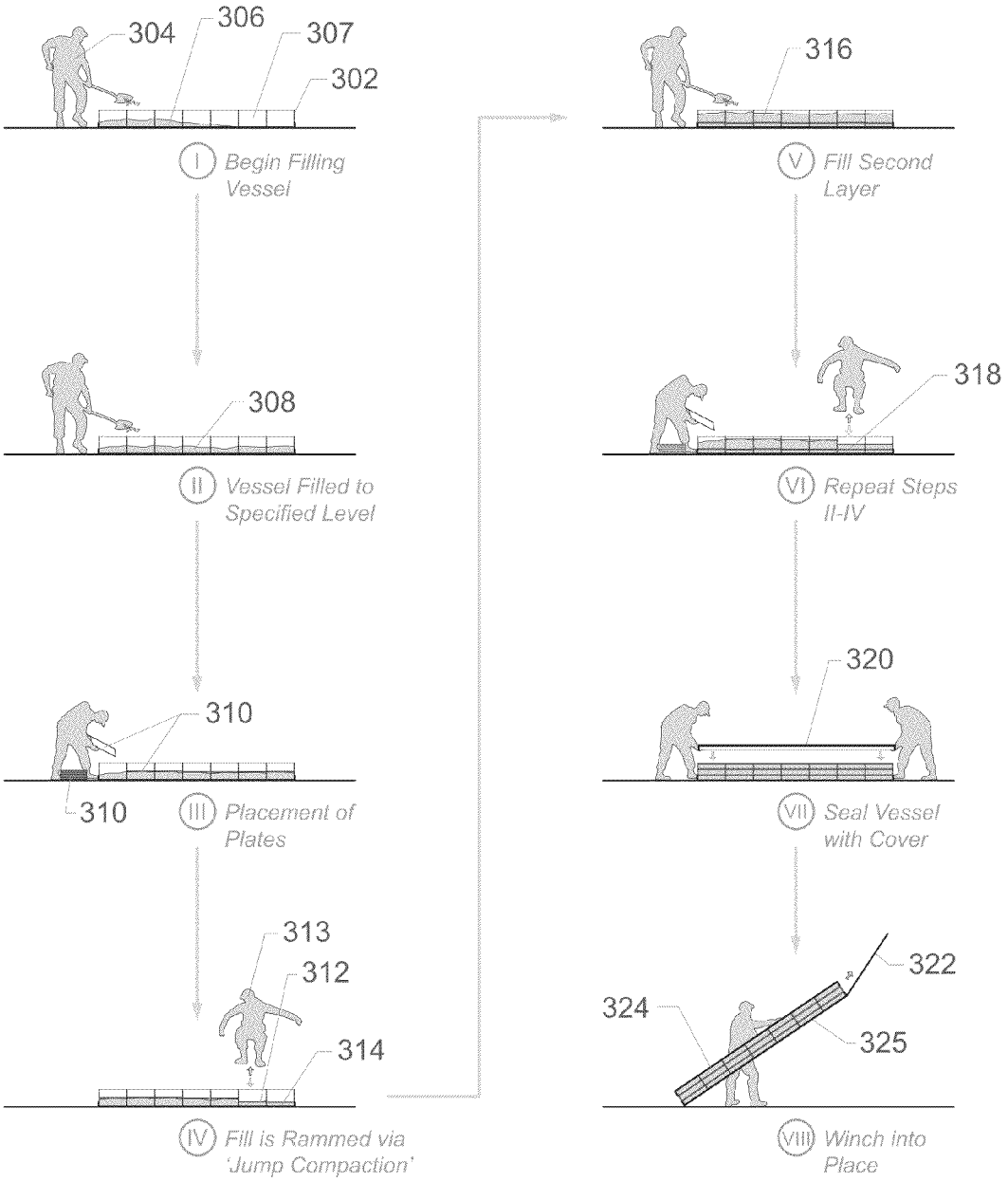
FIG. 32 is a diagram demonstrating the fill method associated with and subsequent positioning of an envelope vessel in the establishment of the strata within an envelope vessel according to one embodiment of the invention. The roman numerals of this figure reference the order of events of this figure alone.
Figure 33:
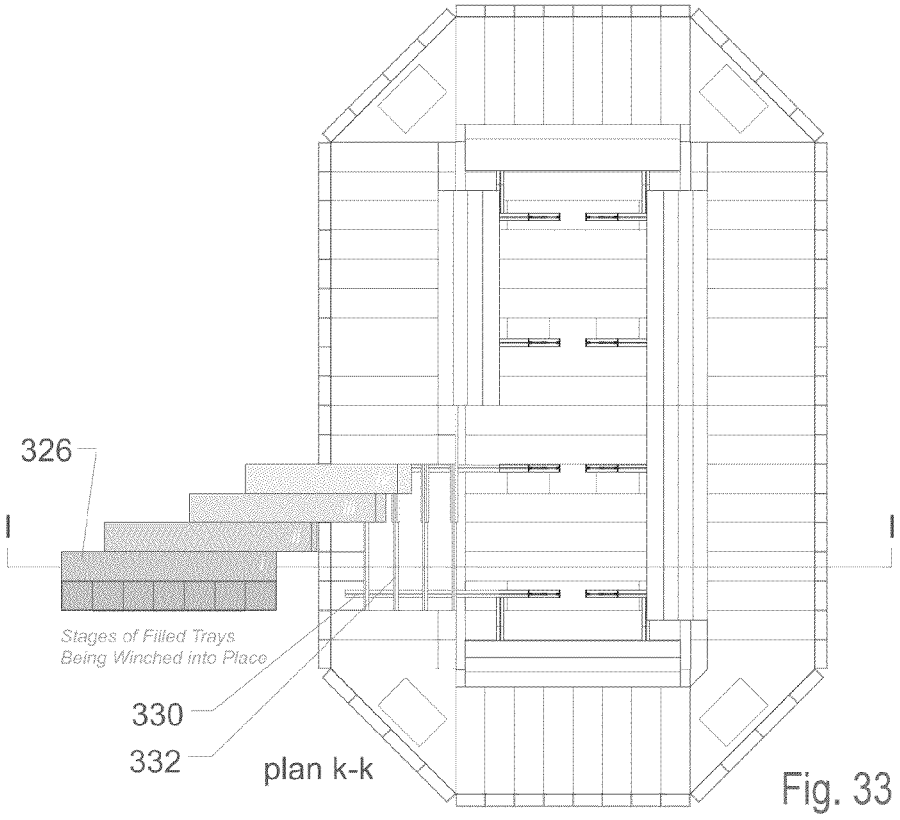
FIG. 33 is a view of diagrammatical plan k-k illustrating the positioning method and arrangement of the filled vessels by use of a winch component according to one embodiment of the invention. The roman numerals of this figure reference the order of events of FIGS. 33 and 34. For clarity, the diagram shares reference numbers with other figures on the same sheet.
Figure 34:
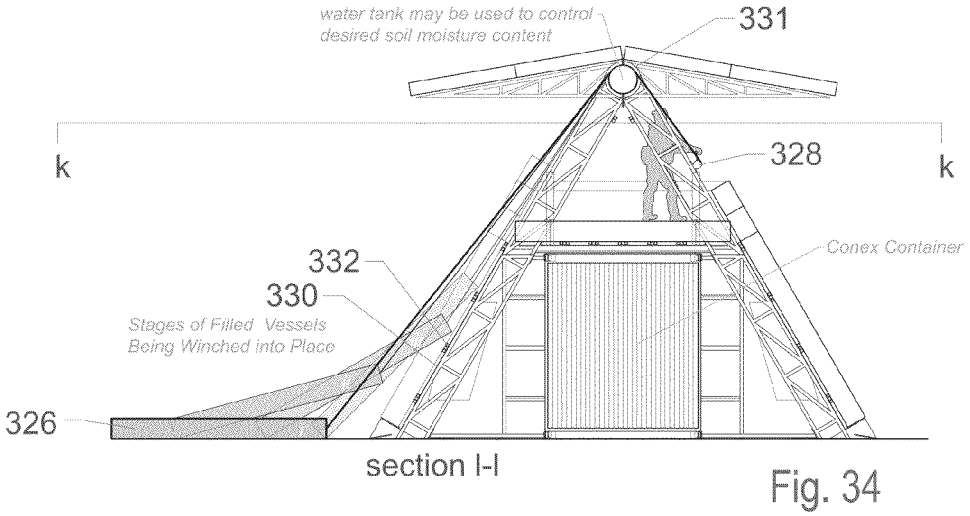
FIG. 34 is a view of diagrammatical section I-I illustrating the positioning method and arrangement of the filled vessels by use of a winch component according to one embodiment of the invention. The roman numerals of this figure reference the order of events of FIGS. 33 and 34. For clarity, the diagram shares reference numbers with other figures on the same sheet.
Figure 35:
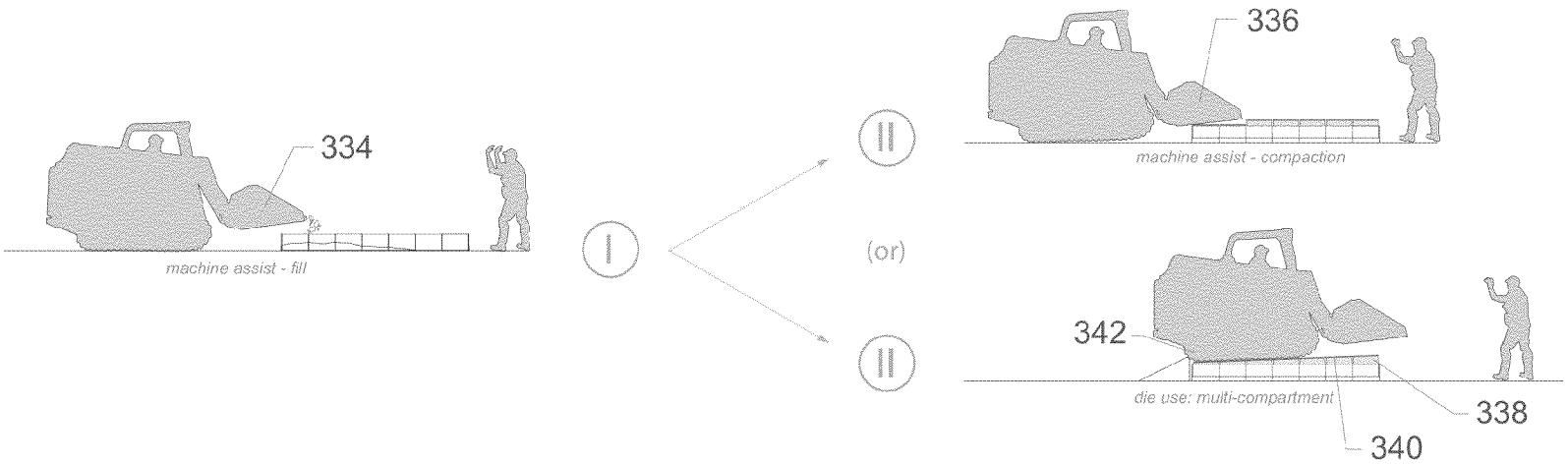
FIG. 35 is a diagram demonstrating the use of heavy equipment, first in the fill process and then in two options for machine assisted compaction according to one embodiment of the invention. One compaction option utilizes a multi-compartment die apparatus and one option shows the use of a bucket in the compaction process. The roman numerals of this figure reference the order of events of this figure alone.

In a preferred embodiment, the vessel component comprises at least two opposing structural side panels 353, 356 connected together by a series of division panels 354, 351; the division panels are perpendicular to the side panels. The structural side panels are capable of supporting fill loads and external loads with minimal deflection when under a spanning condition and when rotated or moved during positioning, as shown in FIGS. 33 and 34. The division panels and the side panels form compartments 358. In one embodiment each panel is constructed of a single or layered material that is solid in form. In another embodiment, the panels are reinforced with a designated structural component 414, such as a truss piece, of the size and shape of the panels. In one embodiment the structural component is jacketed with fabric or semi-rigid material to perform the functions of the panel. In a preferred embodiment, the bottom containment component and top cover component compose a pair of interchangeable covers 352, 368 that enclose both the top and bottom openings of the vessel. Each interchangeable cover comprises a main face panel 352 with side panels 355 that skirt the outside panels of the vessel 351, 360, 353, 356. The skirting becomes the attachment point for a tensile fastening system 350. In one embodiment, the fastening system comprises at least 4 cables that are received by aligned reinforced perforations in each cover; the tightening of the cables draws the top cover to the lower cover, thereby sealing and fully enclosing the fill material within the vessel and/or the vessel's compartments. The vessel and covers are capable of resisting significant deflection from pressure generated by the active compaction process as shown in FIGS. 32 and 35 for the fill material and rotational shifting of the fill material during positioning as shown in FIGS. 33 and 34. In one embodiment, all joints between the side panels and the series of division panels of the vessel are rigid connections and thereby provide a degree lateral bracing.

Figure 40:
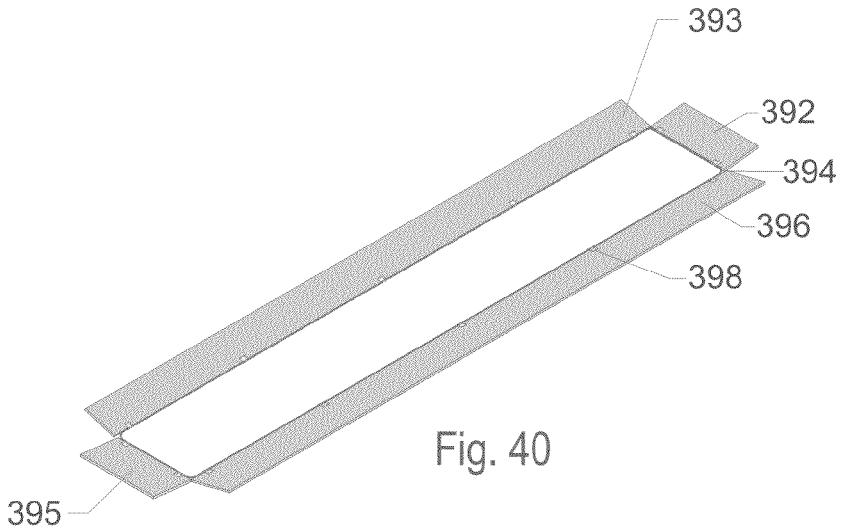
FIG. 40 is an axonometric drawing of a collapsible version of the vessel according to one embodiment of the invention, wherein the vessel is relatively flat in form.
Figure 41:
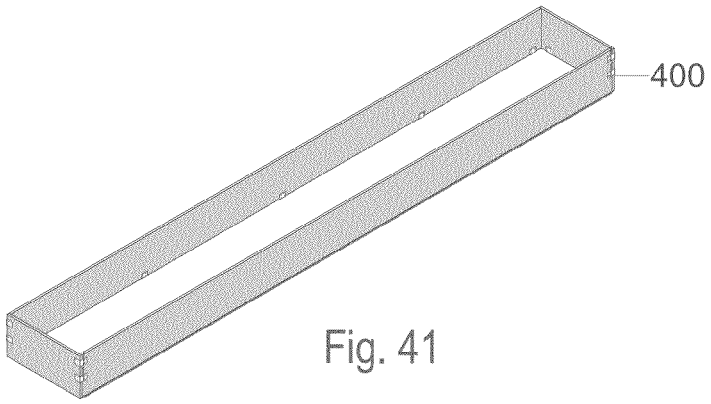
FIG. 41 is an axonometric drawing of a collapsible version of the vessel according to one embodiment of the invention, wherein the vessel walls are folded up.
Figure 42:
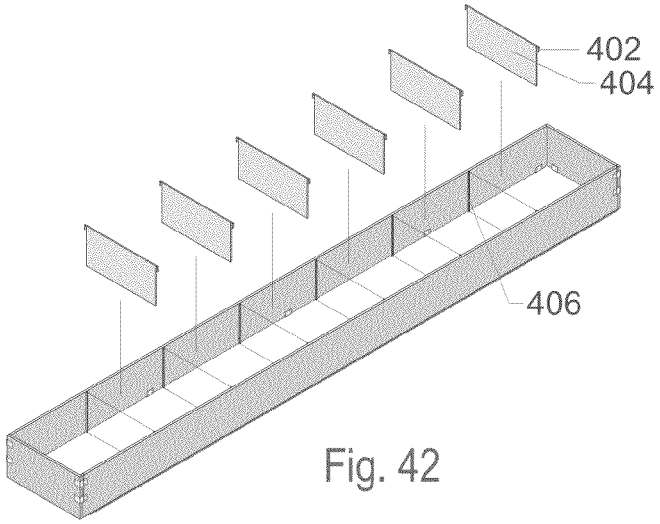
FIG. 42 is an axonometric drawing of a collapsible version of the vessel according to one embodiment of the invention, wherein the vessel walls are folded up and division plates are aligned prior to be inserted into the channel guides on the interior faces of the vessel's structural side walls.

The thickness of the vessel is minimized by the fill method and corresponds to potential threat types and location of the vessel on the shelter. The minimized thickness of the vessel reduces volume in storage. Nevertheless, in one embodiment, the vessel folds into a relatively flat form when empty. The collapsible vessel system comprises four panel walls 392, 393, 395, 396 and a thin rod component 394 that functions as a hinge pin as shown in FIG. 40. The thin rod component is sized and shaped accordingly to run along the bottom perimeter of the vessel in a closed loop. The side 393, 396 and end division panels 392, 395 have knuckle and leaf components 398 fastening along the bottom edge of each inner face to form a standard hinge attachment with the bottom perimeter thin rod component. The outer division panels and structural side panels each have a simple fastening system, such as a hinge clasp 400, so as to lock with the adjacent panels when folded into the voluminous fill arrangement, as shown in FIG. 41. A least one interior division panel 404 is inserted to further brace the folding panels with a bracket system. A bracket 402 is located near the top of each side edge face of each division panel and grips the top edge of the structural side walls on the opposite side of the thin perimeter rod component. A channel piece component 406 is fastened to the interior side of the structural side panel as a guide and brace for the interior division panel where each interior division panel abuts each structural side panel.

In a preferred embodiment, the skirting panels of all covers are ringed with a compressible gasket 348, 416. When two or more vessels are in proper alignment the gaskets on both covers of each vessel align and compress against the gaskets on both covers of all adjacent vessels and form a double seal 418. This seal provides a weather-tight, thermal, chemical and biological barrier.

In one embodiment, the interstitial plate comprises a thin panel of rigid material 362, 410; the length and width of the panel are roughly that of a single compartment of the vessel 358 and the intestinal plate is positioned relatively flat within the vessel, thereby resting in a plane parallel to the main face panel 368 of the cover component. At least one plate may be used for the purpose of ballistic threat mitigation; in a preferred embodiment, the same plate 310, 312 is used as a press in the compaction of the material fill within the vessel, as illustrated in FIG. 32. The plate is left within the compartment as each subsequent layer of fill material is added and compacted. In one embodiment, the plate is used primarily for compaction and replaced or augmented with an alternate rigid, semi-rigid, or non-rigid plate. In various embodiments, the material composition of the plate provides ballistic protection, thermal insulation, acoustic insulation, electromagnetic interference/pulse protection, heat signature manipulation, fallout protection or other mission relevant function. The number of plate 410 and soil 412 layers, the gradation of layers, and material choice is variable according to desirable performance, as shown in FIG. 43; the strata characteristics may be tailored, before and/or during operations, in order to mitigate specific threat types.

The Fill Process: In the preferred embodiment, the envelope is established when at least two filled compartment vessels line the sides of, and lock into, the 'A-frame' based structural system. Prior to this stage and upon delivery, the empty vessels fold out from the A-frame structure and are filled in rapid succession, as shown in FIG. 32. Each vessel 302 is filled in a horizontal position, typically on a ground surface. The vessel apparatus for the temporary shelter system utilizes an active and specific process for the compaction of the fill and establishes composite strata of interstitial plates and compacted fill material. The layered qualities of the strata reduce dimensional requirements needed to provide the equivalent penetration protection of non-compacted or lightly compacted fill systems. The following is a description of one manpower based embodiment of the fill process, as shown in FIG. 32.

The top cover 320 is removed from the vessel 302. Loose fill material 306 is deposited into each empty compartment 307 within the vessel. The compartments are filled to a fraction 308 of their depth. At this point, appropriate amounts of moisture, desiccant, or other additives may be provided to ensure proper moisture content or fill performance control. A rigid plate 310 is placed in each compartment on top of the loose fill. The fill material 314 is compacted using manual effort. In one embodiment, the manual compaction step is accomplished via at least one individual 313 repeatedly jumping on the rigid plate 312 within the vessel compartment. The rigid plate is not removed. The filling, plate placement and compaction steps are repeated any number of times until a desirable number, gradation and arrangement of alternating layers 318 of rammed fill and interstitial plates are established. The top cover 320, 324, 368 is placed on the vessel and is fastened via a tensile cable or strap component 350 to the lower cover 325, 352. This process may be repeated in rapid succession until all necessary vessels are filled.

In one embodiment, multiple vessels are compacted at once utilizing a die system. The die 338 is positioned so as to cover multiple vessel compartments of a single vessel or multiple vessels at once. The die comprises a plurality of blunt compaction teeth 338 of similar size and volume to that of a vessel compartment and a top plate 340, as shown in FIG. 35. The die is aligned with the teeth positioned above the fill material within each vessel compartment; a vehicle or heavy piece of equipment 342 is positioned on the top plate 340 of the die so as to use the vehicle's weight to compact the multiple vessel compartments at one time. The load of the vehicle is distributed among the vessel(s) and respective compartments. In another embodiment, vessels are compacted utilizing mechanical equipment. A vibratory compaction plate, bucket 334 or similar attachment applies pressure to the interstitial plates in order to compact each layer of strata within the compartments. The mechanical compaction works in conjunction with or replaces the manual process of compaction.

After the vessels are filled and the covers are secured, the vessels are hoisted into position via a winch 328 mounted on the A-frame. In one embodiment, the winch cable 331 rests on the axle component during the lifting of the filled vessels 326 to produce a force on the vessel with a high angle of incidence from the horizontal ground plane. The vessels fasten to or rest on the secondary lateral members 332 of the A-frame structure 330 and end framing components 148. This process, as illustrated in FIGS. 33 and 35, is repeated in succession until all vessels are filled and placed in positions as illustrated in FIGS. 7, 8, 9, and 10. In one embodiment, the envelope comprises vertically sloped standing vessels 151, 152, vertically stacked vessels 158, 160, and horizontally aligned vessels 156. The vertically aligned vessels are sloped at the same angle as the A-frame structure and form the wall conditions of the shelter. The horizontally aligned vessels 179, 156 laterally span the distance between the tops of the vertically aligned vessels to create a roof condition. The roof condition doubles as an observation deck 169 above the main habitable area of the shelter and below the rotatable roof barrier at the apex of the A-frame. In one embodiment, the observation deck has parapet walls 242 comprising stacked horizontally aligned vessels 158, 160, that are positioned on the tops of the vertically aligned vessels; the vessels that form the parapet walls rest against and/or are fastened to the secondary lateral members 183 of the framing system.

Figure 8:
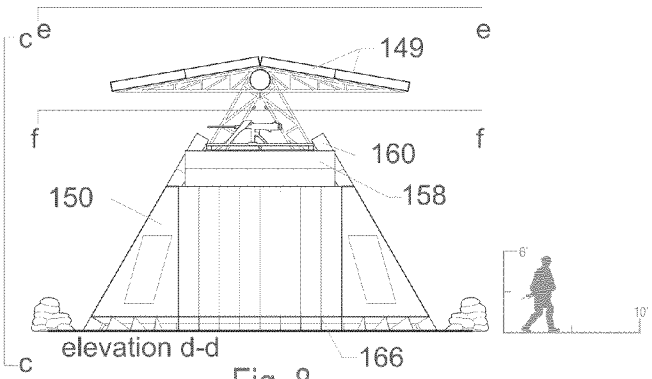
FIG. 8 is a diagrammatical view of elevation d-d illustrating the arrangement of vessels on the envelope and pre-detonation screens on the rotatable roof barrier according to one embodiment of the invention. For clarity, the diagram shares reference numbers with other figures on the same sheet.
Figure 7:
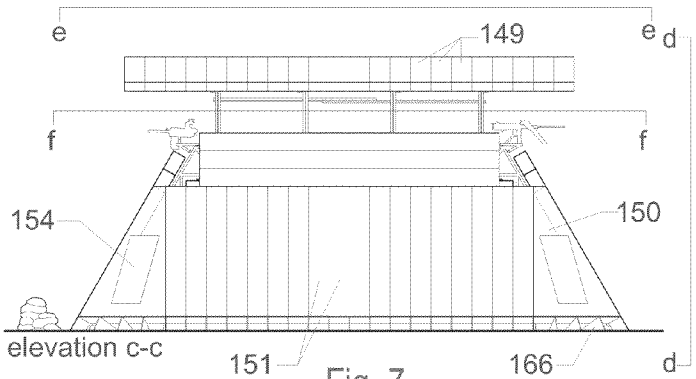
FIG. 7 is a diagrammatical view of elevation c-c illustrating the arrangement of vessels on the envelope and pre-detonation screens on the rotatable roof barrier according to one embodiment of the invention. For clarity, the diagram shares reference numbers with other figures on the same sheet.
Figure 10:
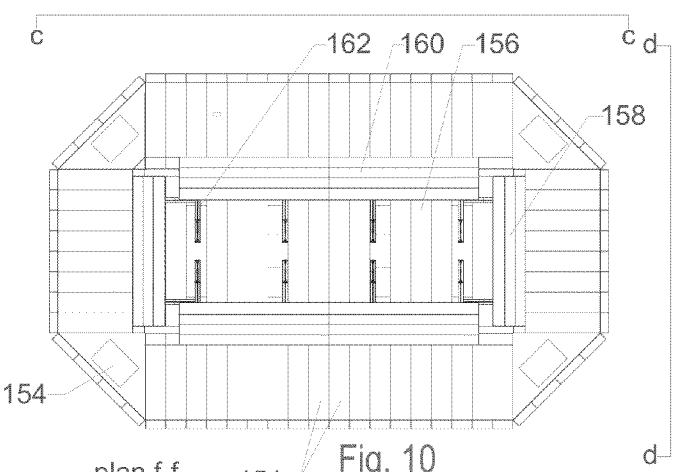
FIG. 10 is a diagrammatical view of plan f-f illustrating the arrangement of vessels on the envelope barrier according to one embodiment of the invention. For clarity, the diagram shares reference numbers with other figures on the same sheet.

The vessels are positioned in such manner that the penetration of a ballistic threat is mitigated as it enters through the main face panel 368 of the vessel's cover component; the first point of penetration would occur at one the mirrored cover components and continue along a line roughly perpendicular to plate-fill strata. The kinetic energy of the ballistic threat is dissipated and the threat is deformed by each subsequent layer of plate and compressed fill the threat must travel through in the strata contained within the envelope vessels. Some allocation for deviation in the angle of incidence for the intended ballistic approach and penetration path may be beneficial and utilized in a sloped armor arrangement of the vessels as shown in FIGS. 7 and 8.

At least two procedures exist for the emptying of envelope vessels prior to the extraction of the shelter system. In one procedure, all filled vessels are pushed or pulled off of the framing system and discarded; in an alternate, procedure the vessels 462 are tilted from the framing structure with the aid of a winch and cable 460 whereupon the covers are unfastened and the strata is emptied from each compartment as show in FIG. 46. The second option is more time consuming, but allows for the recovery of the rigid plate 464 and vessel components.

Figure 29:
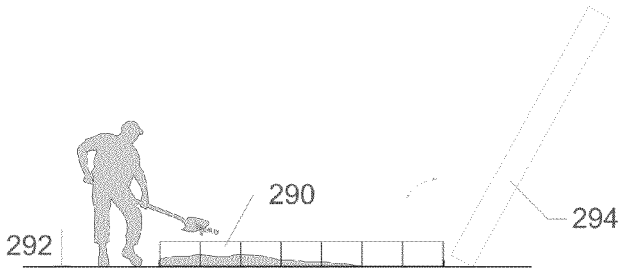
FIG. 29 is a diagram demonstrating the range of motion needed for the fill process and the subsequent rotation of the vessel into a standing/sloped position according to one embodiment of the invention. The figure is to be a comparison to FIGS. 30 and 31.
Figure 30:
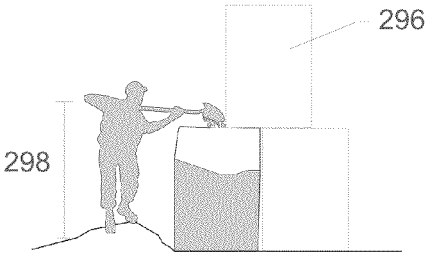
FIG. 30 is a diagram demonstrating the range of motion, large volume of fill, and the subsequent stacking required of the gabion system to form equivalent coverage of protection. The figure is to be comparison to FIG. 29.
Figure 31:
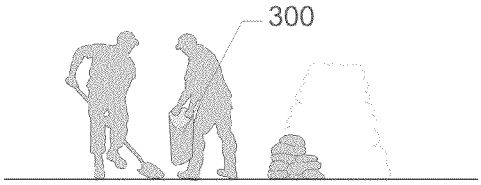
FIG. 31 is a diagram demonstrating the tedious nature of the fill process and the subsequent stacking of the sandbags to form equivalent coverage of protection. The figure is to be comparison to FIG. 29.

Improvements Over Other Fill Systems: A few comments about the temporary shelter system's fill apparatus and envelope system in comparison to common fill systems are appropriate. The gabion is a commonly used material fill apparatus. A fill material container of the gabion is of a single volume and may be rigid; it is an element within a compartment and is not compartmentalized itself. The compartmentalized vessel of the temporary shelter system's envelope differs from that of a gabion in that the entire vessel is rigid, but more importantly, provides structural capacity to resist internal and external compressive and tensile forces. The vessel apparatus for the temporary shelter system comprises both bottom containment and cover components that enclose and fully encase the fill material within the vessel. The structural capacity of the combined vessel walls, the compacted and layered nature of the strata, and the cover and bottom containment components allow the vessel to be rotated, moved, and span significant gaps between support after the vessel is filled. In the preferred embodiment, the compartments of the vessel and the compacted fill characteristics of the strata prevent the fill and its associated loads from shifting and/or settling during rotation and positioning. As such, the vessel apparatus of the temporary shelter system is filled horizontally on the ground surface and then moved into a vertical position 294 after the vessel is sealed, as shown in FIG. 29. This fill practice reduces work, the product of force and distance, during the filling stage. In practical terms, the initial vessel position on the ground surface minimizes the range of motion 292 required for an individual or machine to provide a lifting force when adding fill 290 to the vessel. The range of motion 298 and additive stacking 296 required of gabion is less efficient when providing an equivalent height of protective coverage. This disparity is directly related to the lesser internal structural capacity of the gabion and the gabion's lack of full-containment components; both of these factors do not permit significant movement, rotation or an independent spanning capability by a filled gabion. Additionally, the common sandbag fill technique 300 is comparatively tedious to that of the temporary shelter system's vessel.

The strata contained within the vessel apparatus of the temporary shelter system provides improved mitigation of ballistic threat penetration when compared to that of volumetrically similar arrangements of the gabion or sandbag barriers. This disparity is directly related to the provision of the strata comprising compacted fill material and interstitial plate layers within the vessel apparatus of the temporary shelter system.

The finite dimensions and limited deflection of the temporary shelter system's vessel make it a more suitable modular unit for the construction of a definable, designed shelter space. The temporary shelter system's vessels may be aligned, stacked, angled, and/or fastened with cleaner results compared to the possible arrangements of the more amorphous and less contained gabion system.

Figures 36, 37, 38, 39:
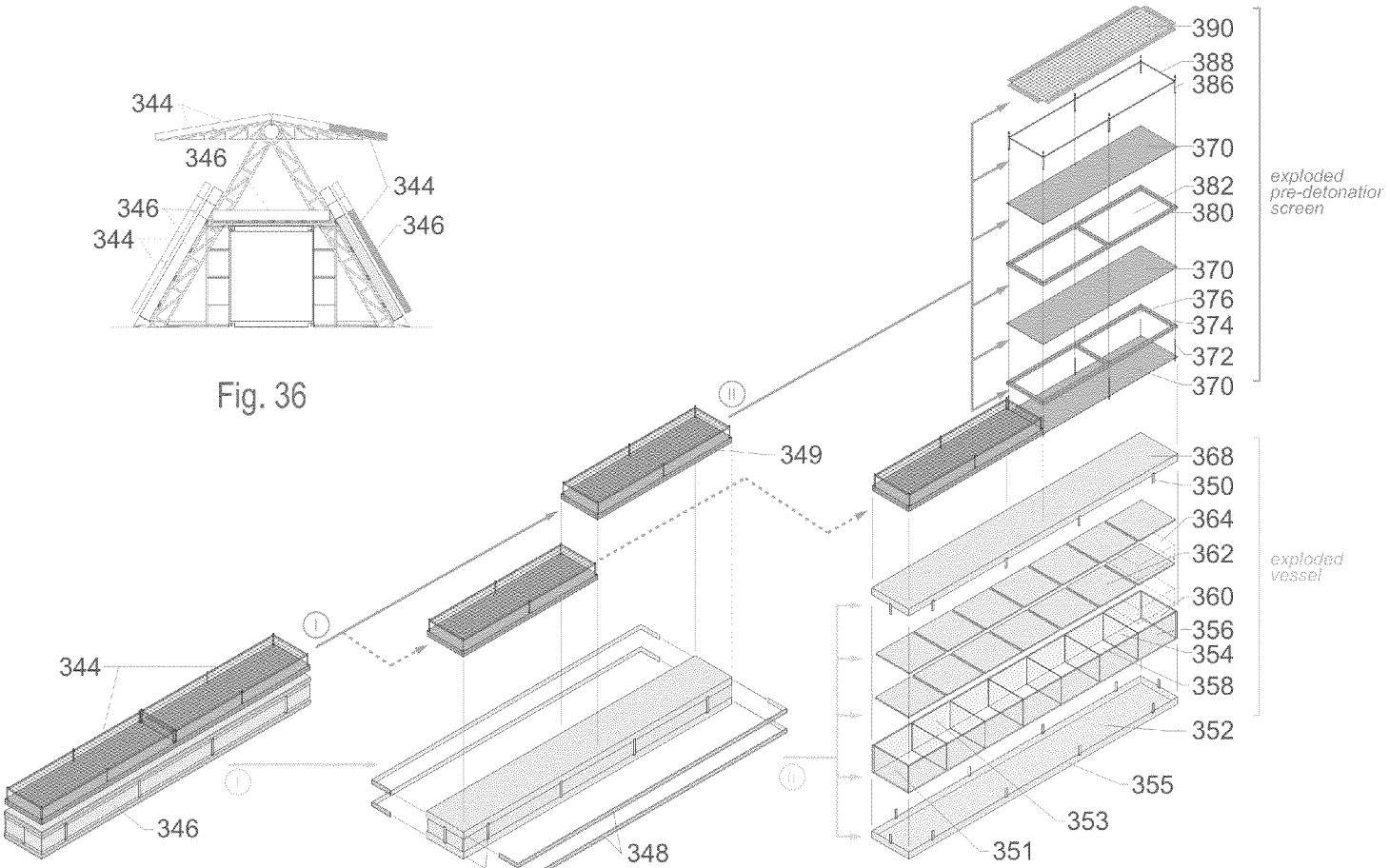
FIG. 36 is a reference diagram illustrating the arrangement of vessels and pre-detonation screens for the rotatable roof system and envelope system according to one embodiment of the invention. The diagram is a useful reference for the related FIGS. 37-39. The diagram shares reference numbers with other figures on the same sheet.
FIG. 37 is an axonometric illustration of two pre-detonation screens aligned and offset from an envelope vessel according to one embodiment of the invention. For clarity, the diagram shares reference numbers with other figures on the same sheet.
FIG. 38 is a partially exploded axonometric diagram of two separated pre-detonation screens, the vessel and sealed cover, and the exploded gaskets that ring the skirting of the vessel covers according to one embodiment of the invention.
FIG. 39 is an exploded axonometric diagram of one exploded and one unexploded pre-detonation screen, and one exploded vessel system comprising a compartmentalized vessel, the mirrored vessel covers, cover fastening straps, interstitial plates, and volume indicia for the compacted fill material within a compartment according to one embodiment of the invention.

Supporting Components for the Envelope System: In one embodiment of the vessel based envelope system, a detonation skin or other unspecified element is positioned offset from the envelope vessels. In a preferred embodiment, a plurality of aligned pre-detonation screens 344 compose the detonation skin of the rotatable barrier and are also applied in an offset position from the envelope vessels 346 as shown in FIG. 36. Though it is within the envelope system's capability to mitigate some common shaped charge and explosive threats, the offset pre-detonation screens 394 are a means to increase the effectiveness of protection and also expedite and minimize the repairs from these and similar threats types.

Figure 14:
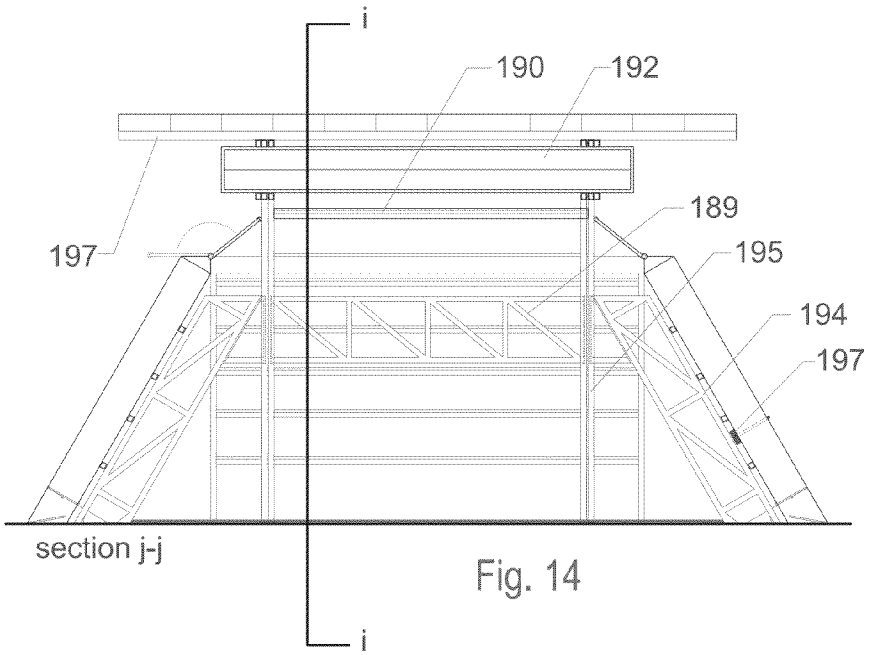
FIG. 14 is a diagrammatical view of lateral section j-j illustrating a simplified non-conex based framing system and envelope vessel arrangement according to one embodiment of the invention. For clarity, the diagram shares reference numbers with other figures on the same sheet.
Figure 45:
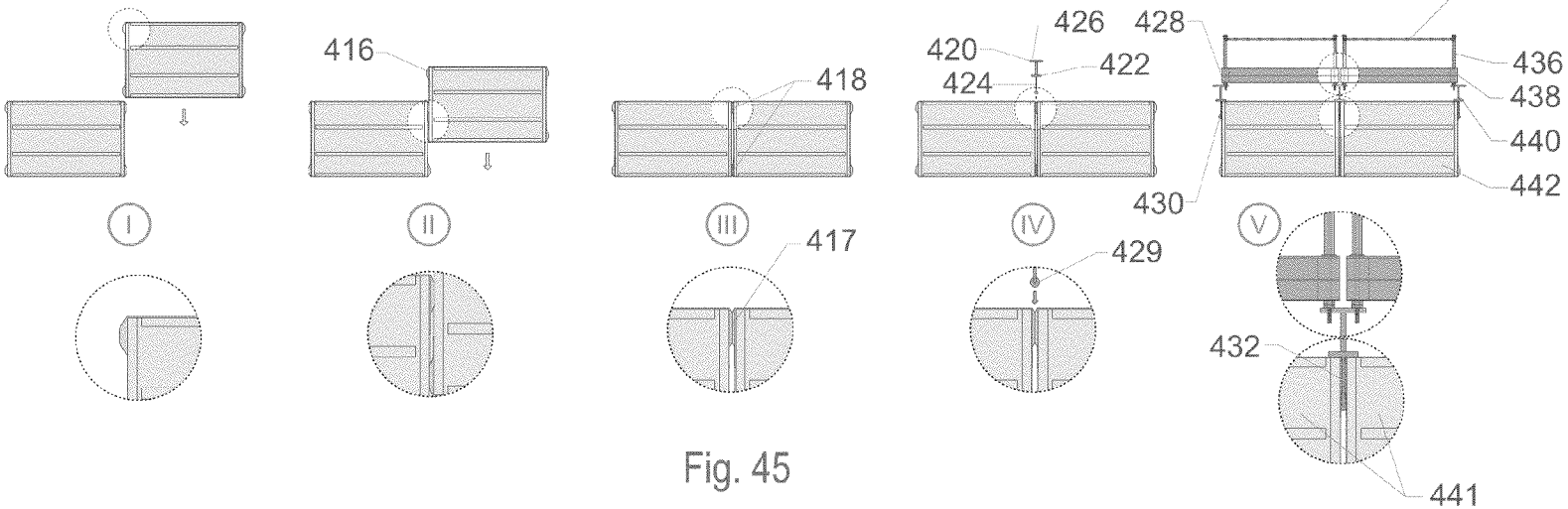
FIG. 45 is a process diagram illustrating the seal formed by the compressive gaskets on the vessel covers (steps I-III) and the insertion of the wedge mount for a screen attachment (step IV-V) according to one embodiment of the invention. The roman numerals correspond to a series of steps within the FIGS. 44 and 45.

In one embodiment, two pre-detonation screens 344 touching end to end cover the face area of a single vessel 346, as shown in FIG. 37. The pre-detonation screens initiate the detonation of a threat before the threat reaches the envelope vessels. A mounting system offsets the pre-detonation screens from the vessels. In one embodiment, the mounting system comprises a plurality of wedge-mounts 440 as the connection between the vessels and the screens, as shown in FIG. 45. The wedge-mount element comprises a web member 424, 440 that bisects two flange elements 420, 422. One flange element 420 runs longitudinally along the top edge of the web and serves as the connection plate for the pre-detonation screens or other attachment. The top flange element has holes 426 to accept a threaded rod 428 of the pre-detonation screen; a pin or similar fastening system may be used to hold the screen in place. The second flange 422 runs longitudinally along the middle line of the web piece. This flange is the stop for the wedge piece and determines the depth at which the wedge-mount will be inserted in-between two adjacent envelope vessels 441. In form, the mounting element resembles a standard I beam with the web extending through the bottom flange. The free end of the webbing 424, 432 is wedged in-between two adjacent ballistic compartment vessels 441. The friction and pressure from the vessels hold the mount in place. In one embodiment, a ratchet lever 197 and cable or equivalent tensile system is used to cinch the aligned vessels together following the placement of the wedge-mounts. In one embodiment, the cable runs in a closed loop around those aligned vessels that compose a wall barrier, as shown in FIG. 14. In one embodiment, at least a portion of the free end of the webbing extends past the depth of the ballistic compartment vessels and is held in place by a pin, clasp or similar fastening system. In one embodiment, the free end of the webbing has a compressible gasket 429 so as to align with and maintain the seal 418 between two adjacent envelope vessels. The double flanges of the wedge mount also provide additional protection at the contact point 417 between vessels that otherwise might be considered a 'soft-spot' in the envelope wall. Generally speaking, in the conex-based embodiment of the shelter system, the conex unit itself may be modified to form a second chemical, biological, and/or thermal barrier. Consequently, the double envelope provides an interstitial space for entry and exit into the shelter.

In one embodiment of the envelope system, passive ventilation is provided by use of pedestal-vents 144, 166 that rest on the ground at perimeter of the shelter's footprint. The pedestal-vents also serve as a footer element for the vertically sloped envelope vessels. A pedestal vent comprises a plurality of triangular panels 212, which stand in a vertical position parallel and offset from one another, and a plurality of horizontal panels. The parallel triangular panels are fastened to a horizontal panel 214 running along the top side of the triangular panels. The bottom and exterior division panel of the vertical vessels 215 rest on the surface of this horizontal panel. Shorter horizontal panel segments 216 laterally span between the lower portions of the triangular panel components. These lower horizontal panel segments are pitched to prevent infiltration and collection of precipitation running down the surface of the envelope. In one embodiment, each gap between vertical triangular panels is closed or opened via a shaped compressible plug 218 with pole attachment 220. The plugs are pulled inward to seal the vents; the plugs are pushed outward to open the vent system.

In one embodiment, at least one ceiling vent 238 perforates the vessel envelope and assists in the movement of air and passive lighting. The provision of the vent is made possible in part because the rotatable roof barrier protects the upper horizontal envelope from the elements. In one embodiment, the vent 254 is also used for the circulation of items and personnel. In a preferred embodiment, the vents are located where the A-frame structure 106, 202 passes through the horizontal surface of the envelope; this necessity precludes the use of a standard size vessel in that location. An armored vent cover comprises at least one bridge plate 206, a plurality of runners, and at an air-bladder seal. The cover plate has two parallel runners 208 on lower face of the cover plate, positioned to ensure a tight fit between the horizontal vessels 204 that form the rest of the horizontal envelope surface. In one embodiment the cover plates have sliding or folding openings that serve ventilation, passive lighting and circulation functions. Below the plates and runners, a plurality of inflatable bladders 210 maintain the seal properties of the outer envelope when conditions dictate a sealed shelter system. Under less rigid operational constraints, field modifications for firing ports 185, 243, observation windows, or other mission relevant features are to be expected.

In one embodiment of the envelope system, the entry and exit conditions occur at the corners of the shelter envelope system. The corners are where the vertical vessels 152 running on the lateral axis of the shelter meet the vertical vessels 151 running on the longitudinal axis of the shelter. Due to the sloping of the vertical vessels, triangular framing 136 and vessel pieces 140 are used to fill the opening at the corner condition. In one embodiment the triangular framing element fastens to the ends of the secondary lateral members 126, 145 that are in turn fastened to the A-frame. A triangular vessel 140, 150 of similar depth and function to the standard rectangular vessel 138 is fastened to the triangular framing element in order to provide protection and continuity of the envelope at the corner condition. All three side panels of the triangular corner piece are structural. Permanent interior division panels form compartments within the vessel of relative volume to that in the standard rectangular vessel. The triangular vessel may have framing to accept a door, port, or other ingress/egress feature 154. As with the standard rectangular vessels, the corner vessel is capable of utilizing the material fill and interstitial plate method. In an another embodiment, the corner condition is protected by an unspecified armor system that does not make use of fill methods or fill apparatus.

A-Frame Based Structural System:

In a preferred embodiment, an A-frame based framing system functions as the fulcrum for the rotatable barrier and is responsible for transferring loads from the barrier and envelope to the ground surface. The framing system comprises at least two main A-frames; each of said A-frames comprises at least two structural legs 106 spaced apart from one another at their respective base and meeting at an apex. At the apex of the A-frame, a circular opening serves as the axle housing and receives a portion of the axle shaft 104 component. The A-frames are parallel and offset in support of the axle component.

In a preferred embodiment, each A-frame is assembled from two truss segments. A lower truss segment 118 fastens to the foot of the upper truss segment 120 to form a single leg of the A-frame; this leg fastens to a mirrored leg to create the A-frame. At least two A-frame components are offset from one another in a series and straddle the protected area 109, 110 of the shelter. The form of each upper truss segment provides for a circular opening when the two legs are fastened together. A cylindrical axle 104, 114 runs through and is received by the circular opening of each upper A-frame truss segment and establishes the longitudinal axis of the shelter. The circular opening formed by the two mirrored upper truss segments serves as the axle housing. The upper truss segments may accommodate a bushing to assist with the bearing and rotational requirements of the cylindrical axle. A horizontal beam 122 runs parallel to the ground and spans the mirrored upper truss segments 120 of each A-frame. The horizontal beam connects to the upper truss segment in close proximity to the bottom connection plate of the upper truss segment. In one embodiment, the horizontal beam serves as the structural support for the horizontal vessels 156 of the shelter envelope. While similar in form and position to that of a collar tie of a standard rafter system, the horizontal beam resists the distributed load of the horizontal envelope.

Conex Based Embodiment: One embodiment of the framing system ties into the structural capacity of the conex as shown in FIGS. 1, 2, 3, 4, 5, and 6. In this embodiment, the protected area 110 of the shelter is contained within at least one conex container 121. The structural A-frames and a plurality of casting rod members 128, 130 transfer the loads from the rotatable barrier and the envelope into the inherently robust capacity of the conex frame. In the conex based embodiment, the lower truss segment 118 attaches the A-frame to the corner castings of the conex unit via at least two casting rod members 128, 130. The conex castings 467 are the fastening point between the conex structural system and the framing system of the shelter. Each lower A-frame truss segment 118 anchors the A-frame to the ground and conex container. The plurality of casting rods run orthogonally off of the vertical conex casting faces. At least one casting rod member 128 carries the load from each A-frame leg to the upper casting 131 and at least one casting rod member 130 carries the load from each A-frame leg to the lower casting 133. Each casting rod member makes contact with the conex casting via a twist lock plate 127 or similar attachment system. Those A-frames 146 not aligned with the castings do not have castings available for attachment; the horizontal beam 122 performs the role of the casting rods in the interior A-frame components. A lower horizontal member 132 is parallel to the upper horizontal beam and runs through the lift ports 469 of the conex at the interior A-frames; the interior A-frames 146 are not aligned with the conex castings; each lower horizontal member spans the mirrored legs of each interior A-frame. Two vertical rods 134 attach to the upper and lower horizontal rods of the each interior A-frame to form a rectangular frame that encompasses the conex. The rectangular frame performs the structural role of the high capacity conex frame.

A plurality of secondary lateral members 126, end framing components 148 and triangular corner frames 136 compose the remainder of the framing system and primarily provide bracing and attachment points for the vessels that compose the material-fill envelope. Generally speaking, a variety of fastening systems may be used to attach the vessels to the secondary lateral members. In one embodiment, the vessels are fastened to the secondary lateral members via hinge, bracket, and plate hardware. In another embodiment, the extra lengths of tensile tightening cable of the mirrored cover components are lashed to the secondary lateral members. In an additional embodiment, at least one attached eyelet on the cover face of each cover component receives an industrial tie which in turn is fastened to a secondary lateral member.

An end-framing component comprises at least one structural member that extends orthogonally off the side of the main A-frame and makes contact with the ground plane. In one embodiment, the end framing 148 comprises two truss segments; one truss segment is the same lower truss segment 118 that is used in the A-frame. The upper truss segment 124 for the end framing fastens to and laterally braces the webbing of the upper truss segment 120 of an outer main A-frame 147. In a conex based embodiment, the upper end framing truss segment 124 fastens to the upper corner casting 131 on the smaller end faces of the conex container; casting rod members 130 fasten the lower end framing truss segment to the lower casting 133 on the end faces of the conex container.

A plurality of secondary lateral members 126, 146 run laterally across the A-frame truss segments, horizontal beams and end framing truss segments. The envelope vessels rest on, or are attached to, the secondary lateral members 330.

Further lateral bracing is provided by the triangular corner frames 136. Each triangular corner frame aligns with the perimeter of the gap that forms in the envelope at the shelter corners due to the sloping sidewalls of the vertical envelope. A triangular corner frame comprises three members; two matching members 137 of the corner frame abut the ends of the secondary lateral members and meet at the apex of the triangular frame. The matching members anchor the ends of the secondary lateral members with a plurality of brackets 139 that are attached to the outer sides of the matching members. The third member 141 of the triangular corner frame connects the two the matching members near the ground surface.

Non-Conex Based Embodiments: The structural performance of the framing system in the non-conex based shelter embodiments are self-contained and independent of the conex structural performance as shown in FIGS. 11, 12, 13 and 14. As the non-conex based embodiments are not tied to the dimensions of the conex unit, they may be of a significantly smaller or larger dimension and footprint when compared to the conex based embodiment. In the first embodiment of the non-conex based framing system, shown in FIGS. 11 and 12, the plurality of main A-frames, the plurality of secondary lateral members, and four triangular corner frames are of similar form and function to that of the conex based embodiment that is shown in FIGS. 2, 3, 4, 5, and 6. The main A-frames are those A-frames that straddle the protected area of the shelter. The structural differences between the conex based embodiment and the non-conex based embodiment are the non-conex based embodiment's alternative form of end framing 172, 194, the absence of casting rod components 128, 130, and the replacement of the horizontal beam 122 and associated rectangular frame components 132, 134 with an alternate framing component 168, 180. The end-framing system for one non-conex embodiment comprises two mirrored A-frames legs 172, 182 that utilize the same lower truss segments 118 of the main A-frames. These two legs meet by fastening to an upper truss segment 170 at their apex. This end framing upper truss segment fastens to and laterally braces the webbing of the upper truss segment of the main A-frame 173. A horizontal truss member 168, 180 replaces the horizontal beam 122 of the conex-based variant in form, position, and function. The horizontal truss member 168, 180 spans and fastens to the mirrored legs of each main A-frame 173. In one embodiment, the attachment point for each horizontal truss member is located at the fastening point 184 between the lower truss segment and the upper truss segment of each mirrored main A-frame leg; the top chord 178 of the horizontal truss attaches to the upper truss segments of each main A-frame and the bottom chord 177 of the horizontal truss attaches to the lower truss segments of each main A-frame. A spanning tie 181 at the foot of each A-frame provides resistance to the outward thrust of all mirrored A-frame legs.

Figure 11:
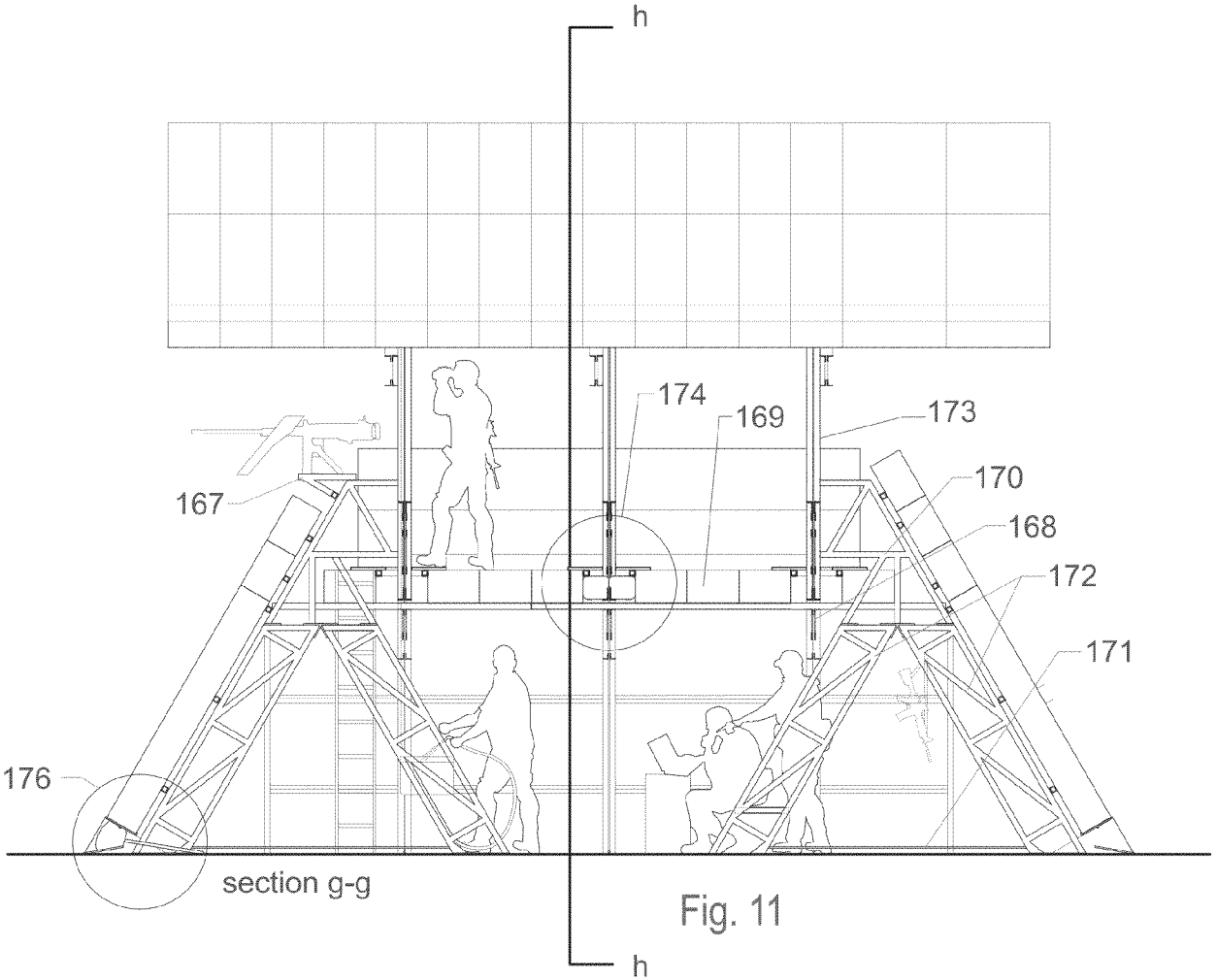
FIG. 11 is a diagrammatical view of longitudinal section g-g illustrating a non-conex based framing system and envelope vessel arrangement according to one embodiment of the invention.
Figure 12:
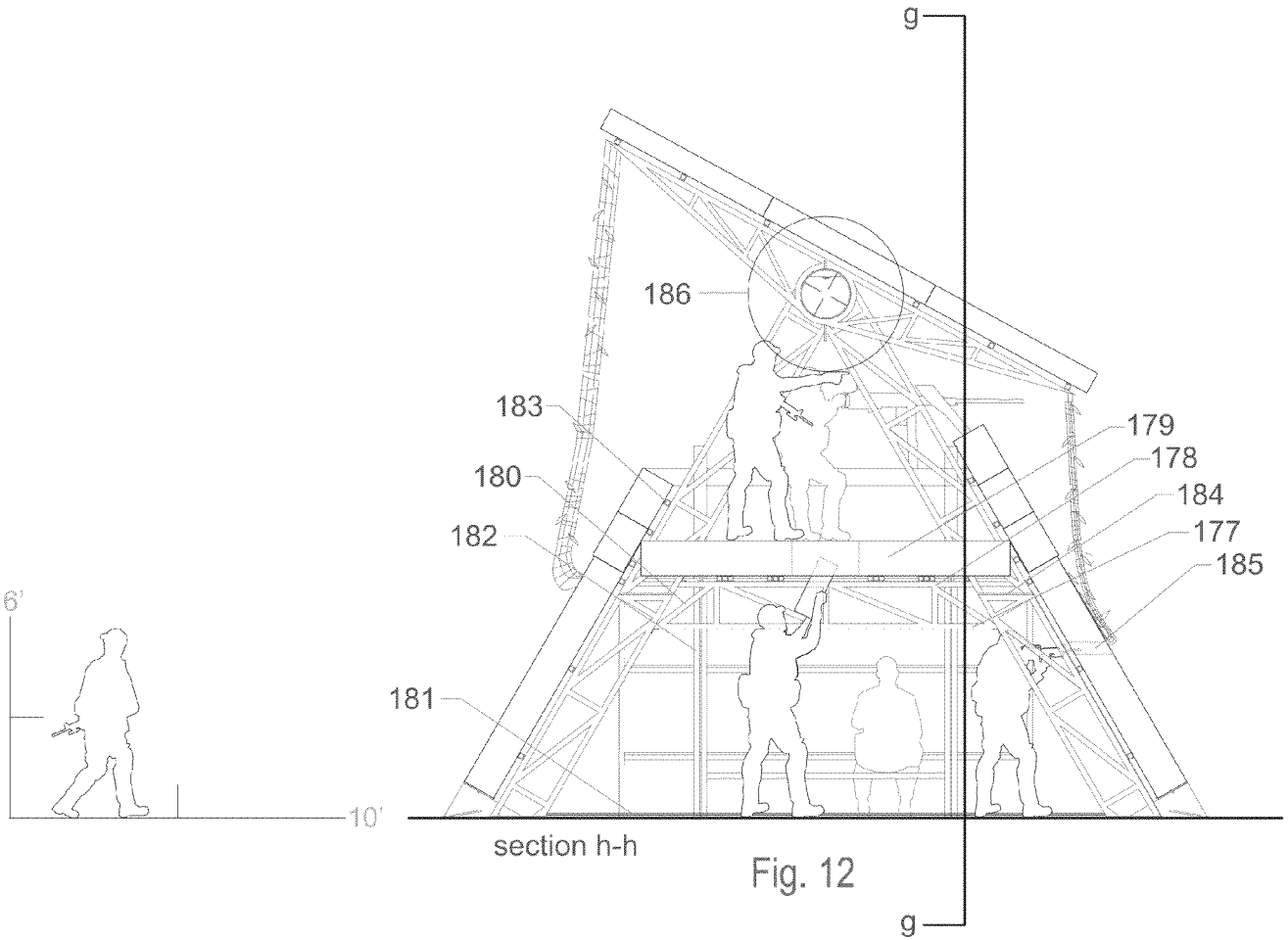
FIG. 12 is a diagrammatical view of lateral section h-h illustrating a non-conex based framing system and envelope vessel arrangement according to one embodiment of the invention.
Figure 13:
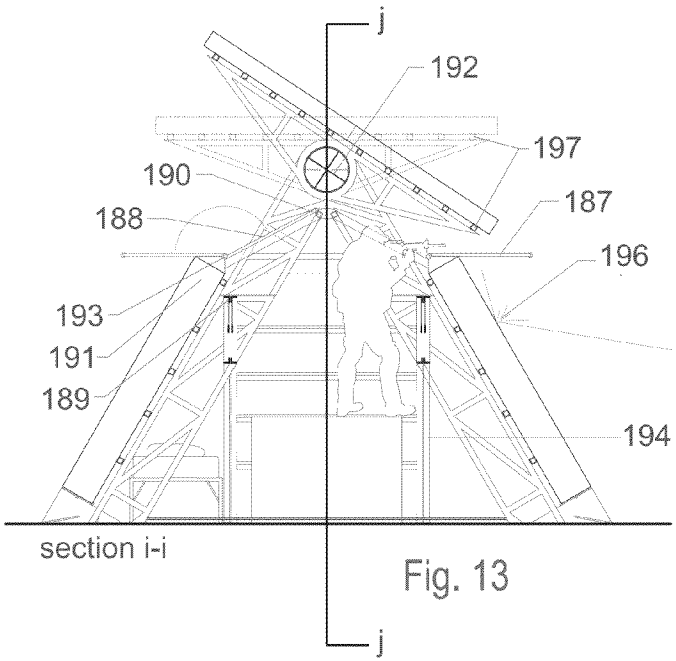
FIG. 13 is a diagrammatical view of lateral section i-i illustrating a simplified non-conex based framing system and envelope vessel arrangement according to one embodiment of the invention. For clarity, the diagram shares reference numbers with other figures on the same sheet.

In a second embodiment of a non-conex based temporary shelter system, shown in FIGS. 13 and 14, the shelter framing and envelope systems are further simplified from the first non-conex based temporary shelter system embodiment presented in FIGS. 11 and 12. Neither the horizontal vessels 179 of the first non-conex based embodiment nor their associated support elements 168, 180 are used in the second embodiment of the non-conex based temporary shelter system.

In the second embodiment of a non-conex based temporary shelter system, a plurality of ports with hinged shutters 188, 187 are positioned at the tops of the sloped vertical vessels 191 that compose the wall elements of the shelter. The ports are used for lighting, ventilation, weapon use, and emergency egress. The opening for the port is created by a gap between the topmost end-face of the vertical vessels 191 and the cylindrical axle 192 at the apex of the A-frame. When folded out, the shutter 187 rests horizontally on top of the vessel to protect personnel from threats 196 deflected from the sloped sides of the envelope. When folded in to the closed position, the free end of each shutter rests on a lateral member 190 below the axle-tank. The restrained end of the shutter has a pin-connection 193 attachment to the top of the vessel envelope wall. The port is at an appropriate height for personnel to observe the exterior environment if standing on the ground surface or if atop an object on ground surface as shown in FIG. 13. The end-framing component 194 comprises at least one structural member that extends orthogonally off the side of the main A-frame 195 and makes contact with the ground surface. A primary lateral member 189 orthogonally spans and laterally braces each main A-frame leg with any adjacent and parallel A-frame legs. The primary lateral member comprises a truss component that fastens to and laterally braces parallel legs of adjacent main A-frames. All other framing components are of similar form and performance to that of the first non-conex based shelter embodiment illustrated in FIGS. 11 and 12.

Figure 24:
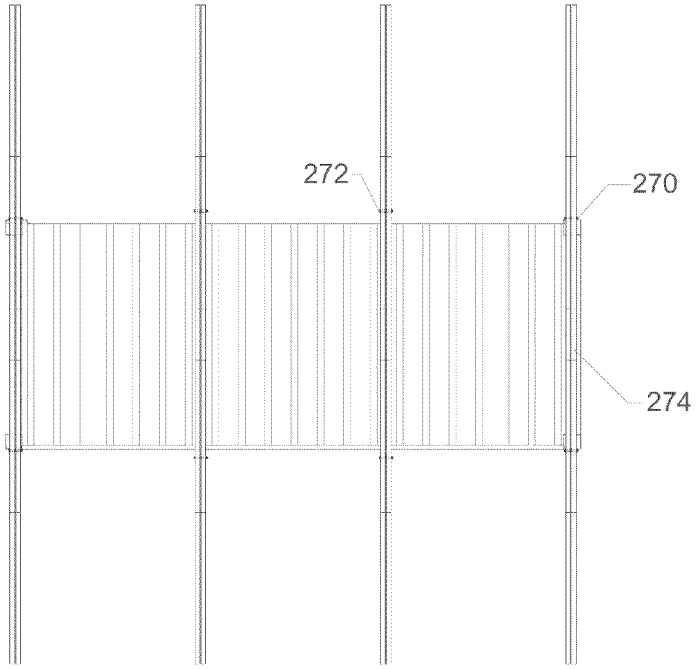
FIG. 24 is a partial framing plan of the shelter taken generally at plan e-e illustrating the collapsible framing system in its expanded form according to one embodiment of the invention. The main A-frames are presented without lateral bracing or end-framing components. For clarity, the diagram shares reference numbers with other figures on the same sheet.
Figure 25:
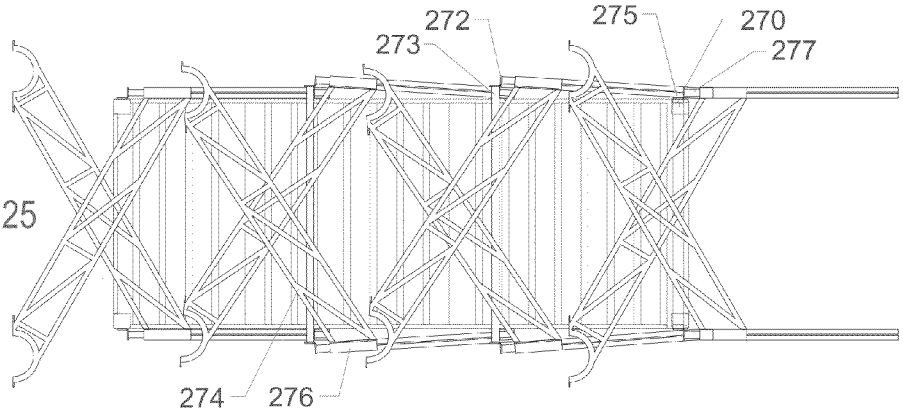
FIG. 25 is a partial framing plan of the shelter taken generally at plan e-e illustrating the collapsible framing system in its folded form according to one embodiment of the invention. The main A-frames are presented without lateral bracing nor end-framing components. For clarity, the diagram shares reference numbers with other figures on the same sheet.
Figure 26:
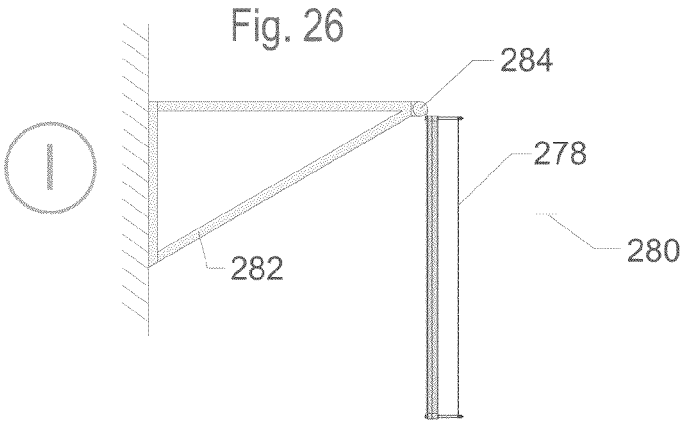
FIG. 26 is a diagram demonstrating the function of the rotatable barrier in a vertical arrangement prior to a flat trajectory ballistic threat making contact with the barrier according to one embodiment of the invention. The roman numeral of this figure references the order of events of FIGS. 26-28. For clarity, the diagram shares reference numbers with other figures on the same sheet.
Figure 27:
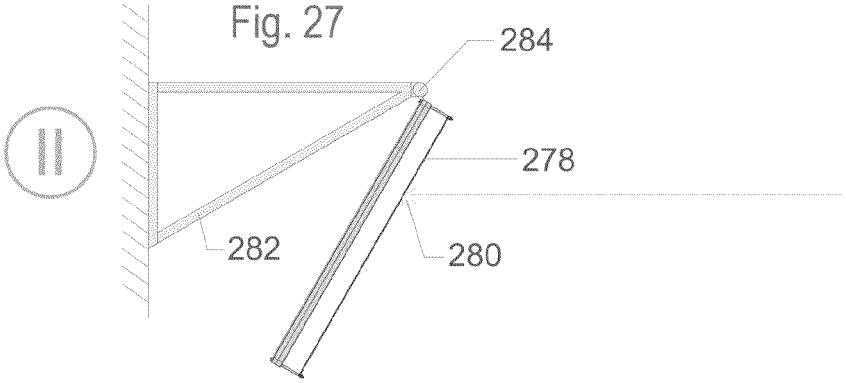
FIG. 27 is a diagram demonstrating the function of the rotatable barrier in a vertical arrangement as a flat trajectory ballistic threat detonates on the barrier according to one embodiment of the invention. The roman numeral of this figure references the order of events of FIGS. 26-28. For clarity, the diagram shares reference numbers with other figures on the same sheet.
Figure 28:
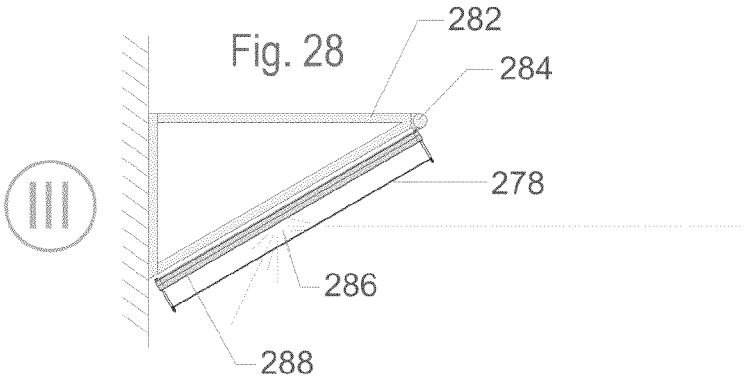
FIG. 28 is a diagram demonstrating the function of the rotatable barrier in a vertical arrangement as the blast energy and shrapnel from a flat trajectory ballistic threat is absorbed and redirected by the barrier according to one embodiment of the invention. The roman numeral of this figure references the order of events of FIGS. 26-28. For clarity, the diagram shares reference numbers with other figures on the same sheet.

Foldable Frame Variant for Conex: In one embodiment of the conex-based temporary shelter system, shown in FIGS. 24 and 25, foldable framing components allow for the reduction of volume in storage and accelerate assembly time of the framing components of the shelter. In one embodiment, each twist lock plate 127 of the casting rods 277, 128, 130 further comprises an additional plate 270, intermediate of the structural member of the casting rod and its associated twist lock plate. The additional plate is connected to the twist lock plate via a hinge component comprising a knuckle component and a pin component. The knuckle and pin are arranged vertically so as to permit the pivoting of each outer main A-frame leg 147 into a position parallel to that of the conex side-walls, as shown in FIG. 25. The horizontal beam 273, 122 and the lower horizontal member 132 have hinged plate connections 272 adjacent to where the vertical rods 144 intersect each horizontal beam and each lower horizontal member on the interior A-frames. The hinged connection plates allow the interior main A-frame legs 146 to fold flat against the vertical walls of the conex unit as shown in FIG. 25. Additionally, each connection component 276 is comprised of two hinged plates where each upper truss segment fastens to each lower truss segment in all main A-frame components. This hinge plate allows each upper truss segment 274 to fold and rest horizontally on the roof surface of the conex container following the unfastening of mirrored upper truss segments and the pivoting of each leg into the position parallel to the conex sidewall, as shown in FIG. 25.

Figure 46:
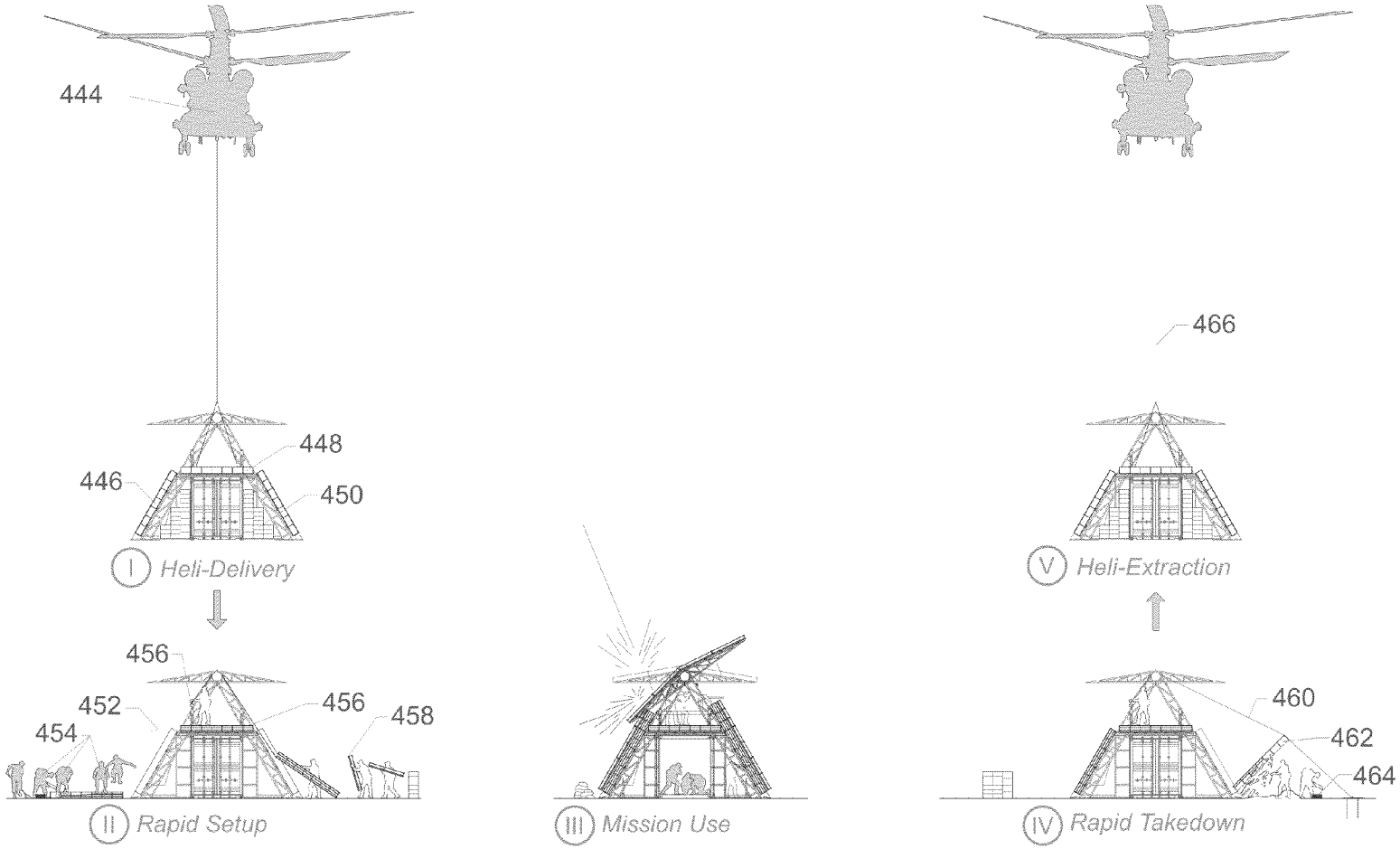
FIG. 46 is a process diagram illustrating heli-delivery (I), setup (II), use (III), takedown (IV), and extraction (V) according to one embodiment of the invention. The roman numerals correspond to a series of steps within FIG. 46 only.
Figure 50:
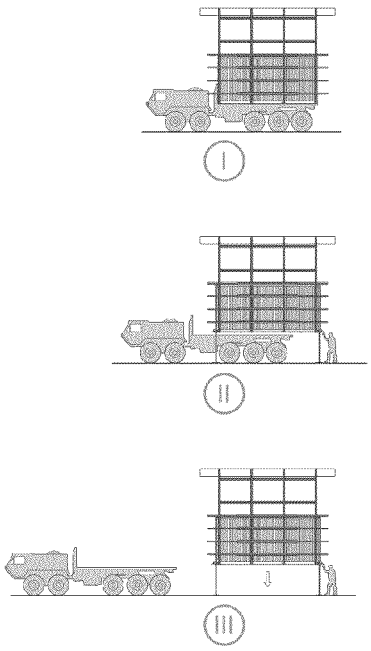
FIG. 50 is a diagrammatical elevation of a partially assembled shelter being removed from the bed of a truck via a temporary hydraulic lift system according to one embodiment of the invention. The roman numerals correspond to a series of steps within FIG. 50 only.
Figure 49:
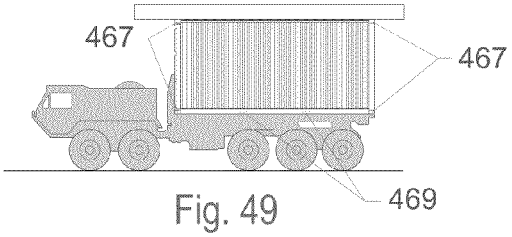
FIG. 49 is a diagrammatical elevation of the shelter components packed within its associated conex container, wherein the shelter is being transported on a truck according to one embodiment of the invention.
Figure 48:
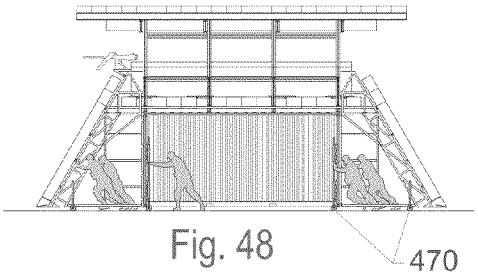
FIG. 48 is a diagrammatical section of the shelter illustrating the use of an extendable wheel system to make minor positional adjustments to the shelter according to one embodiment of the invention.
Figure 47:
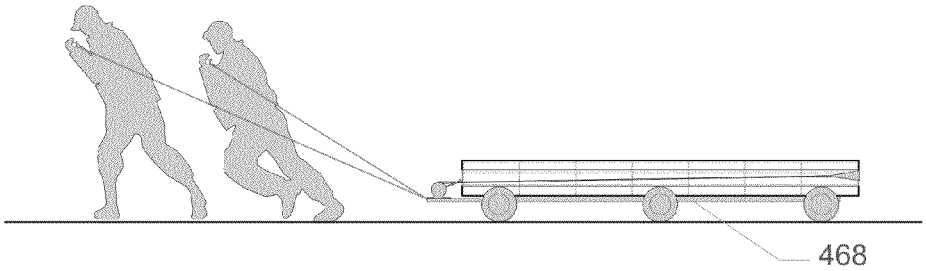
FIG. 47 is a diagrammatical elevation illustrating the use of a wheeled sled with winch and sling to transport a single filled vessel from a non-adjacent fill site to the shelter site according to one embodiment of the invention.

Employment and Use:

Transport and Mobility: The shelter is designed to be delivered and extracted via helicopter or ground vehicle; examples are illustrated in FIGS. 46, 49 and 50. The smaller non-conex based embodiments may be broken into components and delivered via foot transport. A portion of the shelter may be delivered and extracted by one mode and the complementary portion of the shelter by another mode. In one embodiment of the helicopter delivery mode, the shelter is pre-assembled apart from the vessels 448, 446 are empty and the pre-detonation screens 450 are stowed within the shelter or A-Frame structure. A helicopter 444 attaches to the tandem lift points on the conex and transports the shelter to a destination. The rapid setup, take-down, and heliborne capacity of the shelter is attributed to the use of the lightweight envelope system. The on-site fill properties of the envelope greatly reduce the overall transit weight of the shelter. The non-conex based embodiments may be of a smaller footprint and weight than the conex based version. The reduced weight and footprint would expand the range of helicopter types suitable for transport. The shelter may be delivered on a standard conex compatible truck bed. In one embodiment, the shelter is transported in a partially assembled state, as shown in FIG. 50. In another embodiment, the majority of shelter components are contained within the conex during transit, as shown in FIG. 49. The shelter may be transported via a compatible wheeled trailer behind a wheeled or tracked vehicle. In one embodiment, extendable wheels 470 are fastened to the framing components and allow for personnel to make minor positioning adjustments. In one embodiment, wheeled sleds 468 are used to transport individual envelope vessels from a filling area to the shelter; this method is utilized when suitable fill material is not within the immediate footprint of the desirable shelter location.

Figure 51:
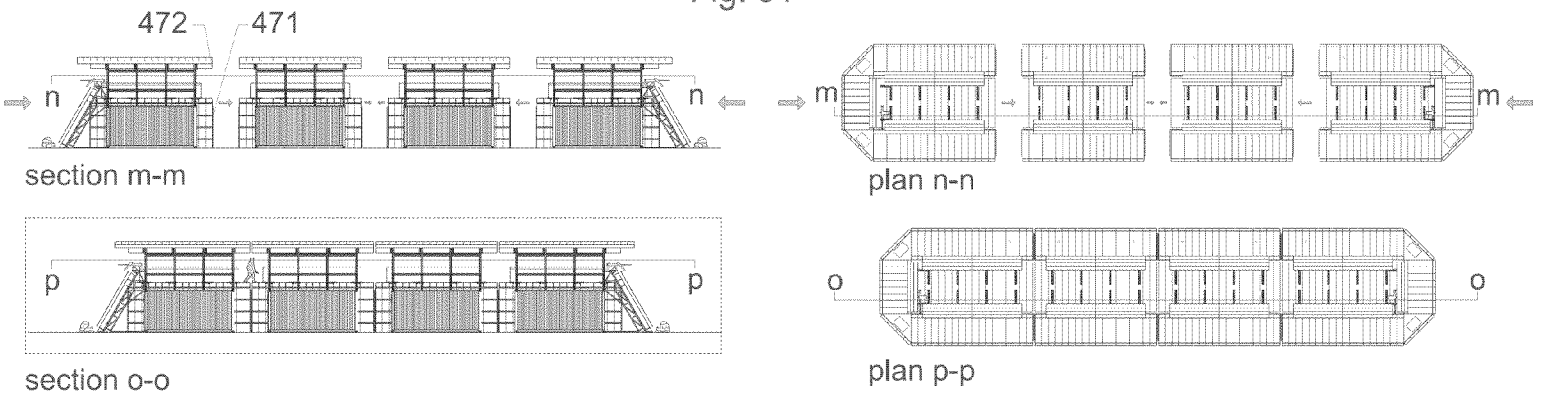
FIG. 51 is comprises views of section m-m, section o-o, plan n-n, and plan p-p illustrating a modular and linked arrangement of multiple shelters according to one embodiment of the invention, wherein section m-m and plan n-n show separate shelters before linking and section o-o and plan p-p show the shelter linked.
Figure 52:
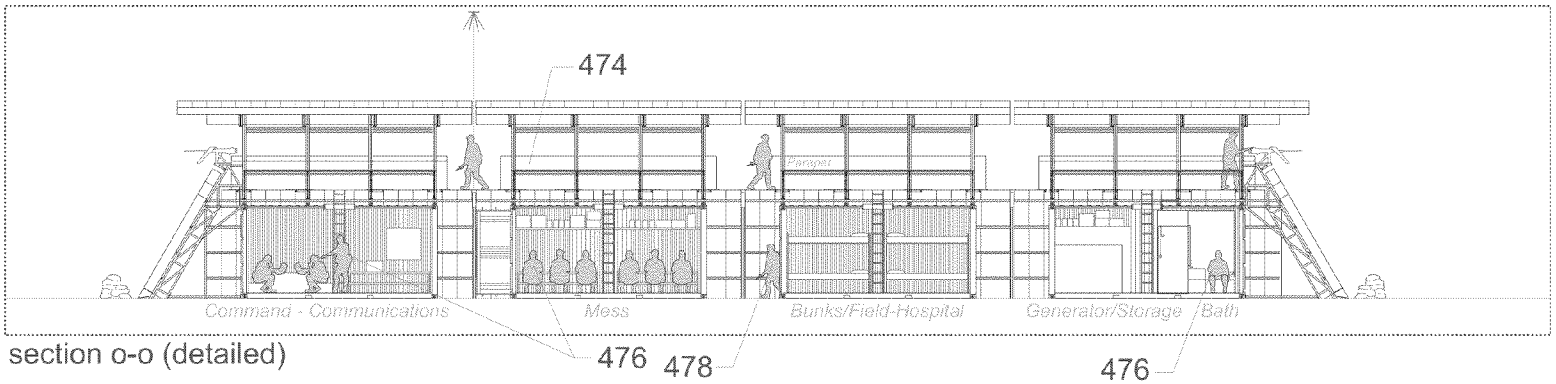
FIG. 52 is a view of diagrammatical detailed section o-o demonstrating the linked observation deck and protected access between shelter programs contained within the conex containers, which are in turn contained within the envelope system according to one embodiment of the invention.

Modular Use: In one embodiment of the shelter system, multiple shelters are linked to create a contiguous enclosed space allowing protected access 478 between conex units and along the upper observation deck 474, as illustrated in FIGS. 51 and 52. The framing envelope components comprising the end framing truss segments 148, the corner vessels 140 and all but one of the matching members 471, 137 of the triangular corner frame 136 are removed on the end of the shelter that connects with an adjacent shelter. The remaining corner frame member is the piece that braces the longitudinally aligned secondary lateral members that abut the triangular corner frame. The remaining corner frame member 471 is the point of contact for the two previously independent framing systems. All secondary lateral members 126, comprising four square tube members fastened together, are temporarily shortened on the rotating roof barrier; the respective pre-detonation screens 472 are removed so as to prevent the overlapping of roof components when the shelters are joined. The shelters are fastened together at the remaining corner frame component pieces 471. Conex units may be assigned a variety of internal program uses, as shown in FIG. 52. In this manner, a range of relevant programs 476 may be provided in one linked installation. Generally speaking, the modular arrangement, in conjunction with an effective seal system, is well suited to sustain operations during an attack; the arrangement also has the potential to reduce the HVAC energy load of installations.

Applications: A few comments about the use and application of the temporary shelter system are appropriate. The flexibility and the modular nature of the temporary shelter system facilitate the system's use with a variety of installation types. More typical mission roles for the shelter include strong-point defense, linear defense, perimeter defense, and engagement area development, as outlined in Chapter 5 of FM 3-21.10. Additionally, the system is compatible with the lighter, more fluid, and temporary mission types. The relatively fast deployment and extraction time of the shelter allow it to be used for operations stretching from a day to weeks or months on end. A non-comprehensive list of potential applications follows.

Figure 53:
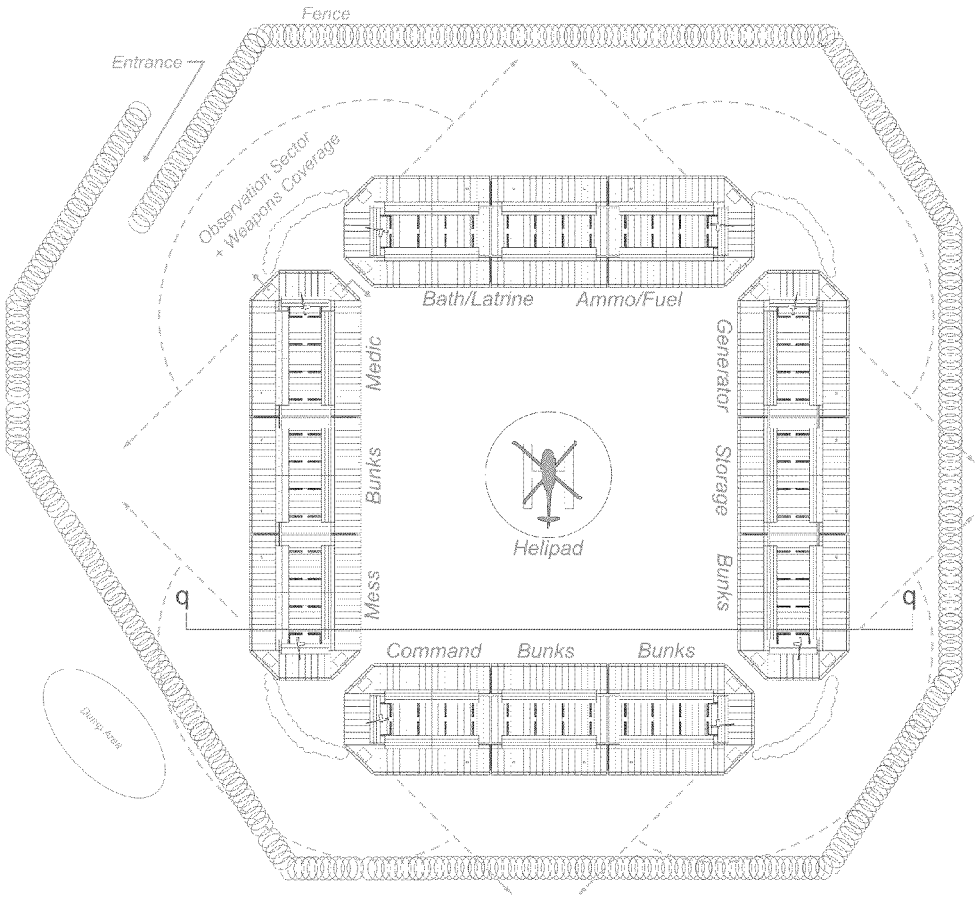
FIG. 53 is diagrammatical plan view illustrating how the shelter system may be employed in an observation post installation according to one embodiment of the invention.
Figure 54:
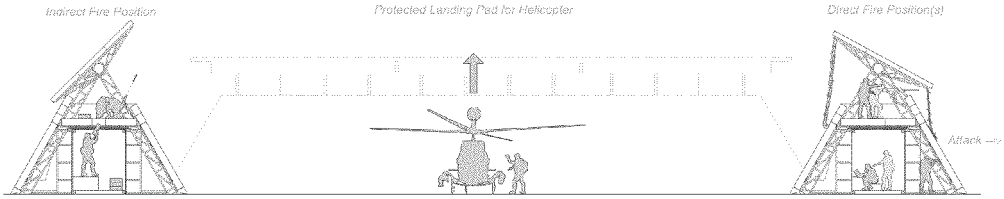
FIG. 54 is a view of diagrammatical detailed section q-q illustrating how the shelter system may be employed in an observation post installation according to one embodiment of the invention, wherein the shelters provide a screen for an internal helipad among other tactical features.

Observation Post: In one application, the shelter system is deployed in support of an observation post position (OP) as shown in FIGS. 53 and 54. Multiple shelters are linked to enclose all of the major components of an observation post as outlined in Chapter 6 of FM 3.21-10; an example of a modular arrangement is illustrated in FIG. 52. When linked together, the shelters establish a protected perimeter; a particular arrangement of shelters and positioning of the rotatable barriers form a visual and protective screen for a helipad, as shown in FIG. 54. Individual shelter units may also be deployed and used in an ad-hoc basis to augment standard observation post design practices.

Figure 56:
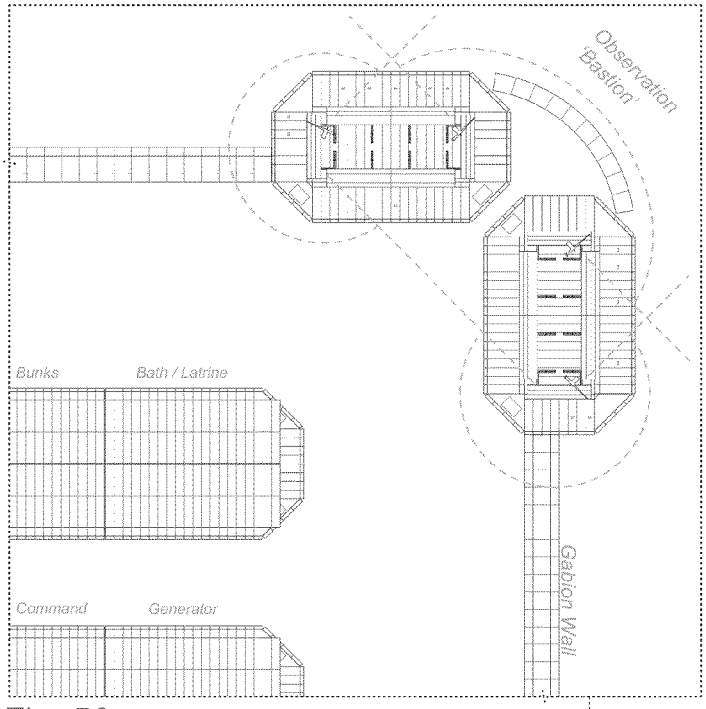
FIG. 56 is diagrammatical detailed plan view illustrating a corner element of the forward operating base of FIG. 55, wherein the shelter is arranged to form a bastion at the base corners and linked shelters house other critical base programs within the perimeter of the installation.
Figure 55:
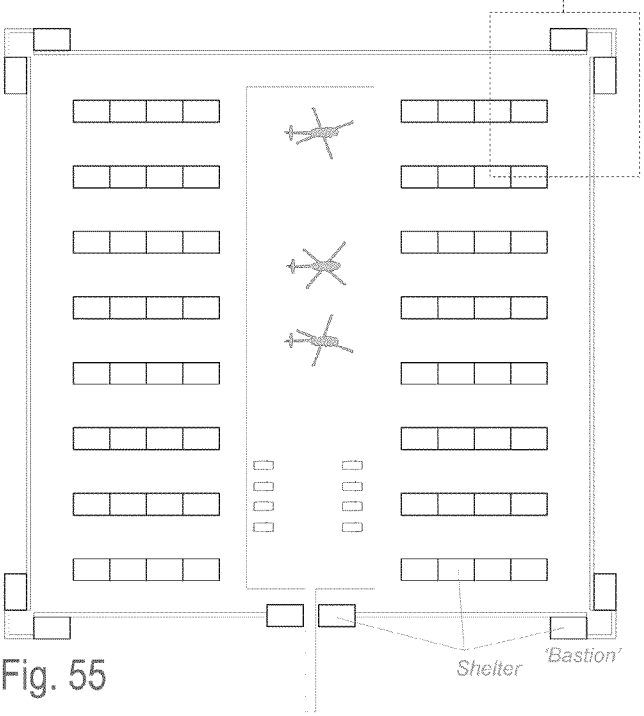
FIG. 55 is diagrammatical plan view illustrating how the shelter system may be employed in a forward operating base according to one embodiment of the invention.

Forward Operating Base: In one application, the is deployed to quickly establish or augment a forward operating base (FOB), as shown in FIGS. 55 and 56. As with the observation post, multiple shelters are linked in a modular fashion. In this manner, critical base components, including but not limited to, mess areas, medical stations, command posts, storage, generators, bunk areas, and bathing areas are housed in linked shelter units. The perimeter defense of the FOB is enhanced by deploying the shelter units to form bastions at the corners of the base perimeter, as shown in FIGS. 55 and 56. This arrangement is a reference to the Vauban defensive element that provides enfilading fire. It is worth noting that the rotatable roof barrier of the shelter may be controlled via the belt and pulley wheel system to actively respond to incoming mortar and rocket fire; in this application, the rotating roof barrier is be set to maximize coverage for each conex as incoming threats are identified.

Figure 59:
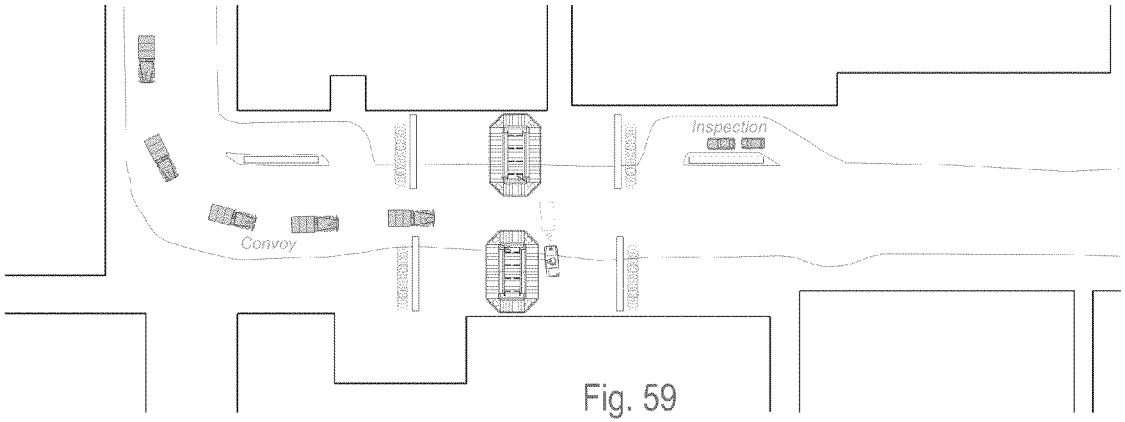
FIG. 59 is diagrammatical plan view illustrating how the shelter system may be employed in a road-checkpoint installation according to one embodiment of the invention.
Figure 58:
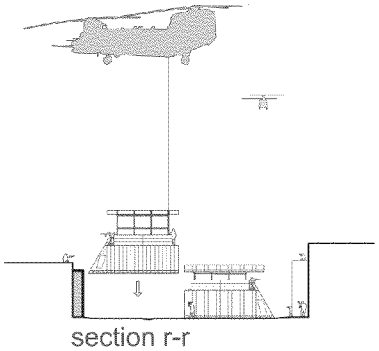
FIG. 58 is a view of diagrammatical section-elevation r-r illustrating how the shelter system may be deployed for a street barricade arrangement according to one embodiment of the invention.
Figure 57:
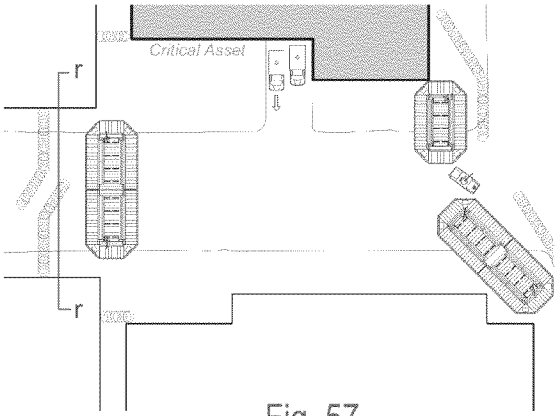
FIG. 57 is diagrammatical plan view illustrating how the shelter system may be employed in a street barricade arrangement according to one embodiment of the invention.

Checkpoint and Asset Defense (Barricade Use): In one application, the shelter system is deployed in support of checkpoint installations, as shown in FIG. 59. The fast deployment and extraction characteristics of the temporary shelter system help the system support more mobile and less predictable security operations. In a similar manner, the shelter system is deployed to form an urban defensive position, as shown in FIGS. 57 and 58. In this application, the multiple linked shelters form street barricades to defend critical assets. Examples of assets include: consulates, government offices, hospitals, utilities, among others. The shelter barricade is also used to seal off and contain a neighborhood or district during times of urban unrest or during urban combat operations. In this manner the shelter becomes a relevant tool in the support of a friendly insurgency or suppression of a hostile insurgency.

Civil Defense: The deployable and temporary nature of the shelter makes it an expedient asset for civil defense. In one application, the shelter is temporarily positioned near public places in order to provide protection from rockets, mortars, small-medium arms fire, biological threats, chemical threats and potentially nuclear fallout. Medical and disaster facilities are setup within the linked conex units.

Figure 60:
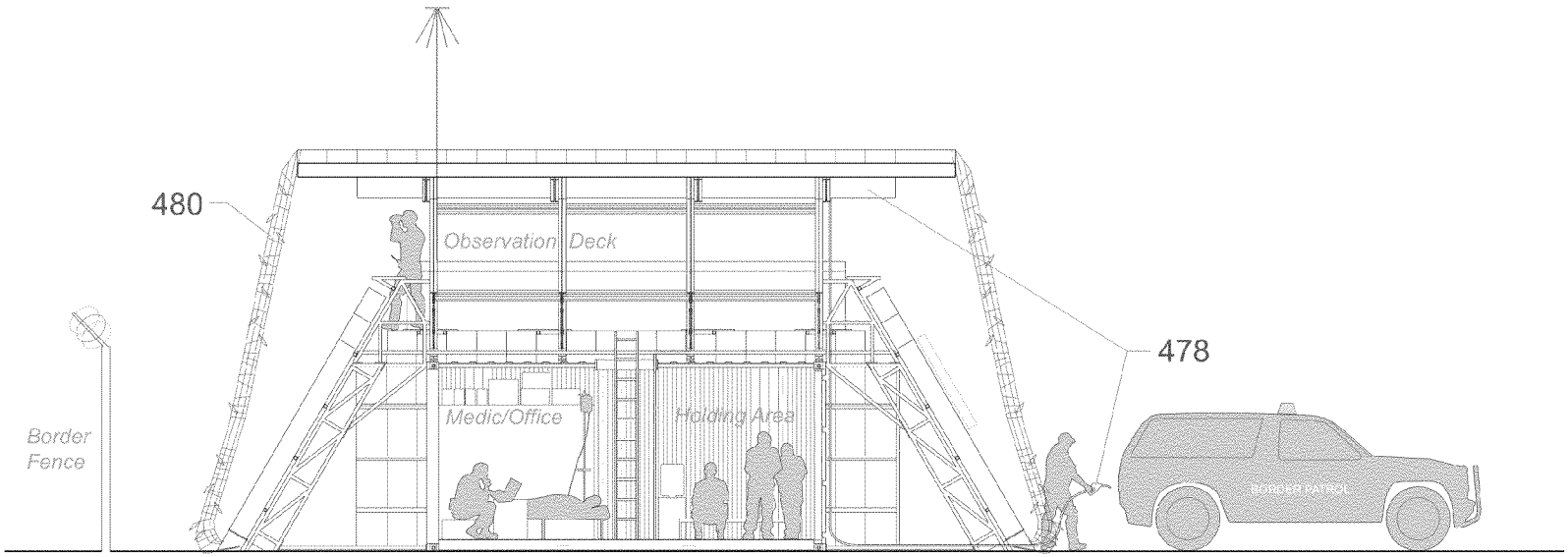
FIG. 60 is a diagrammatical section view taken generally at section b-b illustrating how the shelter system may be altered and employed for use in border security operations according to one embodiment of the invention.

Border Security: In one application, a border security agency uses the shelter as a readily attainable measure to improve security and surveillance in otherwise inaccessible terrain. The flexibility and deployment characteristics of the shelter make it both a financially and time efficient option to quickly augment border protection. Several shelter features are tailored to more effectively meet this role, as shown in FIG. 60. As the threats faced by border agencies differ from that of the military, certain ballistic protection assets of the shelter serve secondary functions. In one embodiment, the vessels are selectively filled with insulation or other functional material. In one embodiment, the axle-tank, normally reserved as a pressurized water source, serves as a non-combustible pressurized fuel tank 478 to service trucks, generators, ATVs, and other equipment. The rotatable roof barrier would primarily serve as protection from the elements and as a mount for a solar cell device. As with military applications, visual screens 480 may be used to obscure agents on the parapet. In this manner, the potential migrant is not able to tell when an observer (the agent) is or is not on duty. If border threats should escalate, the shelter is selectively augmented to provide military grade protection.

Since other modifications and changes varied to fit particular operating requirements and environments will be apparent to those skilled in the art, this invention is not considered limited to the example chosen for purposes of this disclosure, and covers all changes and modifications which does not constitute departures from the true spirit and scope of this invention.

Having thus described the invention, what is desired to be protected by Letters Patent is presented in the subsequently appended claims.

What is claimed is:

1. A rotatable barrier system, comprising:

a contact surface and an axle component; the axle component comprising an axle having a cylindrical axle shaft and an axle housing; said axle housing having a circular opening therein, and receiving a portion of the axle shaft in a pin connection; the contact surface comprising at least one structural, armored planar surface, being rectangular in form, and at least one housing; wherein said contact surface housing has a circular opening therein, receiving the portion of the axle shaft in a moment resistant connection and aligns two edges of said rectangular planar surface in a manner parallel to the axle shaft; wherein said axle housing operates as a pin support and permits rotation of the axle and contact surface when acted upon by a ballistic element, so that, upon contact with the contact surface, a path of said ballistic element is redirected from an original path course, a portion of kinetic energy of said ballistic element is transferred into said axle shaft and said contact surface; and a structural framing system to brace, support, anchor, and offset the axle component from a protected area relative to the contact surface; the framing system comprising at least two main A-frames, each of said A-frames comprising at least two structural legs spaced apart from one another at a respective base and meeting at an apex; said apex having the circular opening of the axle housing and receiving the portion of said axle shaft, and said A-frames being parallel to each other and offset in support of the axle component.

2. The rotatable barrier system according to claim 1, further comprising a second axle shaft with a recessed track, at least one pulley wheel, at least one belt, and at least one damping connector component; wherein the pulley wheel is fastened to an A-frame leg and receives the belt in a closed loop with the aligned recessed track of the second axle shaft, wherein said belt is split by at least one damping connector component, providing damping and control during the rotation of the contact surface and said axle.

3. The rotatable barrier system according to claim 1, wherein the framing system further comprises at least two end-framing components, a plurality of spanning ties, and a plurality of secondary lateral members; each end-framing component comprises a smaller A-frame wherein the apex of each end-framing A-frame orthogonally fastens to and laterally braces at least one leg of an outer main A-frame and each foot of the mirrored legs of the end-framing A-frame rests on the ground surface; a plurality of secondary lateral members, each running laterally across the main A-frames or end-frame components, brace each A-frames with at least one parallel A-frame of the same type; at least one spanning tie connects the two mirrored legs of each A-frame at each leg's respective foot.

4. The rotatable barrier system according to claim 1, wherein the framing system further comprises at least two end-framing components, a plurality of spanning ties, a plurality of primary lateral members, and a plurality of secondary lateral members; each end-framing component comprises a framing member orthogonally attaching to, and laterally bracing, at least one leg of an outer main A-frame; the foot of said end framing member rests on the ground surface; a plurality of primary lateral members, at least one of said primary lateral members orthogonally spanning between the two offset legs of two adjacent and offset main A-frames, provide lateral bracing for said A-frames; a plurality of secondary lateral members, each running laterally across the main A-frames or end-frame components, brace all A-frames with at least one parallel A-frame and all end-framing component s with at least one parallel end-framing component; at least one spanning tie connects the two mirrored legs of each A-frame at each leg's respective foot.

5. The rotatable barrier system according to claim 1, wherein the framing system further comprises a plurality of casting rods, a conex container, at least two end-framing components, and a plurality of secondary lateral members; a casting rod comprises a structural member, with an end plate at each terminus, running orthogonally off of the conex castings, wherein one end plate is a twist lock plate, locking into the conex casting; at least one casting rod proceeds from each of the vertical faces of the conex castings and attaches to the respective A-frame leg or end framing component aligned with said casting face, except in the case of the upper castings that are aligned with the end-framing, wherein each end-framing component attaches to the vertical face of each aligned casting via its own twist lock plate; each end-framing component comprises a framing member orthogonally attaching to and laterally bracing at least one leg of an outer main A-frame and the foot of said end framing member rests on the ground surface; a plurality of secondary lateral members, each running laterally across the main A-frames or end-frame components, brace all A-frames with at least one parallel A-frame and all end-framing component s with at least one parallel end-framing component; the A-frames transfer loading from the axle housing to the casting rods and the ground surface; the casting rods transfer loading from the A-frame members to the conex container; the conex container transfers loading from the casting rods to the ground surface.

6. The rotatable barrier system according to claim 5, wherein each A-frame leg comprises two truss segments, an upper and a lower truss segment, and each twist lock plate of the casting rods further comprises an additional plate, intermediate to the structural member of the casting rod and a respective said twist lock plate, being connected to said twist lock plate via a hinge component comprising a knuckle component and a pin component, wherein the knuckle and pin components are arranged vertically so as to permit the pivoting of each A-frame leg into a position parallel to that of the conex sidewalls; each upper truss segment of each leg temporarily fastens to a respective mirrored opposite and the upper and lower truss segments for each A-frame leg fasten to one another via hinged connection plates permitting the upper truss segment of each A-frame leg to pivot into a position resting relatively flat on a roof element following the unfastening of mirrored upper truss segments and the pivoting of each leg into the position parallel to the conex sidewalls.

7. The rotatable barrier system according to claim 1, wherein the contact surface is positioned as a roof element, each contact surface housing is a supporting rafter element and the planar surface is a detonation skin; the detonation skin being a planar armored but non-structural covering that fastens to and is supported by secondary lateral members; at least two of said rafter elements are parallel and offset, and at least two supporting secondary lateral members linking and laterally bracing the rafter members; the secondary lateral members being attached between the detonation skin and the rafter members; the secondary lateral members transferring loads from the detonation skin to the rafter members; the rafter members transferring loads from the secondary lateral members to the axle shaft.

8. The rotatable barrier system according to claim 7, wherein the detonation skin of the contact surface comprises at least one pre-detonation screen; wherein the pre-detonation screen comprises an absorption component and an offset mount component for an existing detonation element; the absorption component comprises at least one frame sandwiched between panel sheets with a void space therewithin; wherein said void space may be augmented with an absorptive fill type or left empty; in the case of a plurality of frames, the frames will be stacked with a panel sheet between each frame; each frame comprises two parallel side members and at least two shorter members, each of said shorter members fastening to each of the two parallel sides members to form a rectangular frame; the panel sheets and frames being fastened together with a threaded rod running through each of the plurality of aligned holes in both the frame and the panel sheets and extending past one of the outermost panel sheets; the mounting component comprises at least four sleeve members; each sleeve attaching to each of the two adjacent sleeve members by at least one orthogonally aligned mounting rod to form a rectangular shape having roughly the same perimeter as the that of the absorption component frames, wherein the extended portion of each threaded rod of the absorption component aligns with, and is received by, a single sleeve member of the mounting component; the absorption component and mounting component fastening together via at least fastening component at end of each threaded rod; wherein said mounting rods are offset from the absorption component, thereby providing an offset attachment point for an existing detonation element.

9. The rotatable barrier system according to claim 7, further comprising a roof barrier having a rotatable roof surface and a solar cell device affixed thereto.

10. The rotatable barrier system according to claim 9, wherein the rotation of the roof surface provides a clear field of fire for use of weapons positioned below or behind the barrier.

11. The rotatable barrier system according to claim 1, wherein the cylindrical axle shaft comprises a hollow and enclosed axle shaft, with liquid therewithin, and at least one hose attachment extending from said axle to an area behind or below said axle shaft.

12. The rotatable barrier system according to claim 11, wherein the hollow axle shaft further comprises at least one interior flange; said flange being radially aligned and providing hydraulic resistance during the rotation of the axle.

* * * * *